US009950416B2

(12) United States Patent
Kutsuna et al.

(10) Patent No.: US 9,950,416 B2
(45) Date of Patent: Apr. 24, 2018

(54) HANDLE AND POWER TOOL COMPRISING SAME HANDLE

(71) Applicant: MAKITA CORPORATION, Anjo-shi, Aichi (JP)

(72) Inventors: Tomoyuki Kutsuna, Anjo (JP); Ryo Sunazuka, Anjo (JP); Yoshitaka Machida, Anjo (JP); Masahiro Ito, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 89 days.

(21) Appl. No.: 14/784,797

(22) PCT Filed: Apr. 16, 2014

(86) PCT No.: PCT/JP2014/060836
§ 371 (c)(1),
(2) Date: Oct. 15, 2015

(87) PCT Pub. No.: WO2014/171490
PCT Pub. Date: Oct. 23, 2014

(65) Prior Publication Data

US 2016/0075007 A1 Mar. 17, 2016

(30) Foreign Application Priority Data

Apr. 17, 2013 (JP) ..... 2013-086962

(51) Int. Cl.
*B25F 5/00* (2006.01)
*B25D 17/04* (2006.01)
(Continued)

(52) U.S. Cl.
CPC ..... *B25D 17/043* (2013.01); *B25D 17/24* (2013.01); *B25F 5/006* (2013.01); *B25F 5/02* (2013.01); *B25F 5/026* (2013.01); *B25D 2222/57* (2013.01)

(58) Field of Classification Search
CPC ..... B25F 5/006; B25G 1/01
See application file for complete search history.

(56) References Cited

U.S. PATENT DOCUMENTS 2,205,769 A 6/1940 Sweetland
5,299,475 A 4/1994 Stroop
(Continued)

FOREIGN PATENT DOCUMENTS

DE 4440630 C1 6/1996
DE 10004467 A1 6/2001
(Continued)

OTHER PUBLICATIONS

May 20, 2014 International Search Report issued in International Patent Application No. PCT/JP2014/060836.
(Continued)

*Primary Examiner* — Jeffrey O'Brien
(74) *Attorney, Agent, or Firm* — Oliff PLC

(57) ABSTRACT

To provide a handle that is effective at achieving both vibration resistance and usability. A handle attached to a tool body of a power tool has: a grip portion; a connecting portion that connects to the tool body; elastic element interposing regions that are formed between the grip portion and the connecting portion; elastic elements disposed in the elastic element interposing regions; a powder filling region formed between the grip portion and connecting portion; and a plurality of powder bodies that fill the powder filling region.

6 Claims, 16 Drawing Sheets

(51) Int. Cl.
*B25F 5/02* (2006.01)
*B25D 17/24* (2006.01)

(56) References Cited

U.S. PATENT DOCUMENTS

| | | | | |
|---|---|---|---|---|
| 5,848,946 | A | 12/1998 | Stillinger | |
| 6,648,535 | B2 * | 11/2003 | Ferrara, Jr. | B25G 1/102 16/421 |
| 6,832,413 | B1 | 12/2004 | Applewhite et al. | |
| 7,676,890 | B2 * | 3/2010 | Zhang | B25F 5/006 16/421 |
| 7,708,260 | B2 * | 5/2010 | Eicher | B25F 5/006 173/162.2 |
| 8,082,634 | B2 * | 12/2011 | Frank | B25F 5/006 16/426 |
| 8,231,438 | B2 * | 7/2012 | Kuhnle | B24B 23/028 451/359 |
| 8,545,966 | B2 * | 10/2013 | Vito | B25G 1/01 428/156 |
| 8,621,719 | B2 * | 1/2014 | Nakashima | B25F 5/006 16/422 |
| 8,695,724 | B2 * | 4/2014 | Nakashima | B23D 51/01 173/162.2 |
| 8,756,766 | B2 * | 6/2014 | Zhang | B25F 5/006 16/421 |
| 8,914,947 | B2 * | 12/2014 | Weiss | B25D 17/043 16/426 |
| 9,073,197 | B2 * | 7/2015 | Yamauchi | B25F 5/006 |
| 9,370,860 | B2 * | 6/2016 | Rieger | B25F 5/006 |
| 2004/0136769 | A1 | 7/2004 | Ferrara | |
| 2004/0154133 | A1 * | 8/2004 | Polzin | B25F 5/006 16/430 |
| 2006/0219419 | A1 * | 10/2006 | Sugiyama | B25F 5/026 173/162.2 |
| 2007/0143966 | A1 * | 6/2007 | Fischer | B25F 5/006 16/422 |
| 2008/0148524 | A1 * | 6/2008 | Wiker | B25F 5/006 16/431 |
| 2009/0035543 | A1 * | 2/2009 | Vito | B25G 1/01 428/212 |
| 2009/0039576 | A1 * | 2/2009 | Eicher | B25F 5/026 267/137 |
| 2009/0158600 | A1 * | 6/2009 | Ishai | B25G 1/00 30/314 |
| 2009/0307875 | A1 * | 12/2009 | Nakashima | B25F 5/006 16/436 |
| 2010/0206596 | A1 * | 8/2010 | Kamegai | B23D 51/01 173/162.2 |
| 2011/0005790 | A1 * | 1/2011 | Frank | B25F 5/006 173/162.2 |
| 2012/0012353 | A1 * | 1/2012 | Foerster | B25F 5/006 173/162.2 |
| 2012/0160533 | A1 * | 6/2012 | Kamegai | B25D 17/24 173/162.2 |
| 2016/0377139 | A1 * | 12/2016 | Vito | F16F 3/093 267/141 |

FOREIGN PATENT DOCUMENTS

| | | | |
|---|---|---|---|
| JP | H03-53651 | U | 5/1991 |
| JP | H05-116077 | A | 5/1993 |
| JP | 2005-138240 | A | 6/2005 |
| JP | 2006-289562 | A | 10/2006 |
| JP | 2007-168069 | A | 7/2007 |
| JP | 2009-090450 | A | 4/2009 |
| JP | 2009-297887 | A | 12/2009 |
| JP | 2011-000684 | A | 1/2011 |
| JP | 2011-254706 | A | 12/2011 |
| KR | 20090097234 | A | 9/2009 |
| WO | 96/14966 | A1 | 5/1996 |

OTHER PUBLICATIONS

Jul. 28, 2016 Office Action issued in Japanese Patent Application No. 2013-086962.
Oct. 27, 2016 Office Action issued in German Patent Application No. 102014001999.2.

* cited by examiner

HANDLE AND POWER TOOL COMPRISING SAME HANDLE

TECHNICAL FIELD

The present invention relates to a handle for a hand-held power tool.

BACKGROUND ART

Japanese non-examined laid-open Patent Publication No. 2005-138240 discloses a handle for a hand-held power tool. This handle has an elastic body formed of elastomer between a fixed part fixed to a tool body and a grip part.

Problem to be Solved by the Invention

In the above-described known handle, transmission of vibration caused in the tool body to the grip part is reduced by the elastomer elastic body.

In order to enhance the vibration proofing effect in a vibration proofing structure using an elastomer elastic body, it is necessary to soften the elastomer. If the elastomer is softened, however, the rigidity of the handle as a whole is reduced. Therefore, connection of the grip part with respect to the fixed part becomes unstable, so that the operability for a user holding the grip part is deteriorated. Thus, in the handle using elastomer, a tradeoff relation exists between the rigidity and the vibration proofing effect of the handle.

Accordingly, it is an object of the present invention to provide a handle that is effective in achieving both vibration-proof property and operability.

Means for Solving the Problem

In order to solve the above-described problem, according to a preferred aspect of the present invention, a handle which is mounted to a tool body of a power tool is provided. The handle has a grip, a connection part which is connected to the tool body, an elastic element interposing region formed between the grip and the connection part, an elastic element disposed in the elastic element interposing region, a powder filling region formed between the grip and the connection part, and powders filled in the powder filling region. The elastic element interposing region and the powder filling region may be formed as separate regions, or they may be formed integrally with each other as one region. The "power tool" typically represents a hand-held power tool such as an electric grinder and an impact tool, but also suitably includes a shouldering type power tool such as a bush cutter. Further, the "handle" of this invention suitably includes a main handle fixed to a power tool and an auxiliary handle which is removably attached separately from the main handle.

According to this invention, the grip is connected to the connection part via the elastic element and the powders. When an operation is performed with the connection part mounted to the tool body of the power tool, the elastic element elastically deforms in response to vibration caused in the tool body. As a result, transmission of vibration to the grip is reduced. The powders contact each other and vibrate in response to vibration caused in the tool body. At this time, frictional resistance is generated between the powders. As a result, transmission of vibration to the grip is reduced. The amount of elastic deformation of the elastic element is increased by reducing the hardness of the elastic element. Thus, the kinetic energy absorbed by elastic deformation of the elastic element is increased. Therefore, vibration which is transmitted to the grip is effectively reduced. On the other hand, the rigidity of the elastic element is reduced by reducing the hardness of the elastic element. The reduction of rigidity of the elastic element is however compensated by the powders. Thus, reduction of rigidity of the whole handle is prevented. Therefore, vibration which is transmitted from the connection part to the grip is effectively reduced, and the grip is stably held by the user. Specifically, the acceleration generated in the handle when a user holds the grip and operates the handle is smaller than the acceleration of vibration caused in the tool body. Therefore, the power inputted into the grip is received by the powders, so that the grip is stably held by the user. As a result, the vibration-proof property and operability of the handle is improved.

According to a further aspect of the handle of the present invention, the handle has a bag filled with the powders, and the bag is disposed in the powder filling region. The "bag" is preferably formed of a flexible material such as rubber, cloth and vinyl.

According to this aspect, with the structure in which the powders are filled in the bag, the powders can be easily arranged in the powder filling region.

According to a further aspect of the handle of the present invention, the elastic element interposing region and the powder filling region are formed side by side in a direction from a region of the connection part which is connected to the tool body toward the grip. Specifically, the elastic element interposing region and the powder filling region are arranged in order in a direction from a region of the connection part which is connected to the tool body toward the grip. In other words, the elastic element interposing region and the powder filling region are arranged side by side.

According to a further aspect of the handle of the present invention, the elastic element interposing region and the powder filling region are formed side by side in a direction crossing the direction from a region of the connection part which is connected to the tool body toward the grip. Specifically, the elastic element interposing region and the powder filling region are arranged in order in a direction crossing the direction from a region of the connection part which is connected to the tool body toward the grip. In other words, the elastic element interposing region and the powder filling region are arranged in parallel.

According to a further aspect of the handle of the present invention, the connection part is connected to the tool body by threadably engaging with the tool body. The grip and the connection part extend in a prescribed direction, and the connection part is arranged inside the grip. The handle has a rotation stopper that prevents the grip and the connection part from rotating around the prescribed direction by a prescribed amount or more with respect to each other. Typically, the rotation stopper is formed both in the elastic element interposing region and in the powder filling region. The rotation stopper may be formed in either the elastic element interposing region or the powder filling region.

According to this aspect, with the structure in which the rotation stopper prevents the grip and the connection part from rotating by a prescribed amount or more with respect to each other, operability of the handle is improved.

According to a further aspect of the handle of the present invention, the rotation stopper is formed both in the elastic element interposing region and in the powder filling region. In the case in which the elastic element interposing region and the powder filling region are separately formed, the rotation stopper is provided in both the elastic element interposing region and the powder filling region. With this structure, the grip can be effectively prevented from rotating with respect to the connection part.

According to a further aspect of the handle of the present invention, the powder filling region is formed inside the elastic element.

According to this aspect, the elastic element and the powders can be combined into a unit. This structure is effective in size reduction and improvement of assemblability of the unit of the elastic element and the powders. The unit is applied, for example, in a handle connecting part of a bush cutter as the power tool.

According to a different aspect of the present invention, a power tool having the handle according to any one of the above-described aspects is provided. The elastic element and the powders are arranged to reduce vibration which is caused in the tool body in a first direction and a second direction different from the first direction and transmitted from the connection part to the grip. As for "the first direction and the second direction different from the first direction" here, typically as a plurality of directions crossing a longitudinal direction of the grip, the longitudinal direction of the power tool is defined as the first direction, and a direction crossing the longitudinal direction of the power tool is defined as the second direction. Further, typically, the elastic element compressively deforms. Particularly, the elastic element compressively deforms in the first direction.

According to this aspect, operability of the grip (the handle) for operating the power tool is improved while transmission of vibration to the grip is prevented. Particularly, vibration which is caused in the tool body in the first and second directions and transmitted to the grip is effectively reduced by the elastic element and the powders.

According to a further aspect of the power tool of the present invention, the power tool includes an operation rod as the tool body, a cutting unit that is disposed on one end of the operation rod and rotatably supports a cutting blade, and a driving unit that is disposed on the other end of the operation rod and drives the cutting blade. The handle is connected to the operation rod. Further, the elastic element interposing region of the handle is formed between the operation rod and the connection part around a center line of the operation rod, and the powder filling region is formed in the elastic element. Specifically, the powder filling region is formed in the inside of the elastic element. In this case, preferably, a plurality of such elastic elements may be arranged in a circumferential direction around the center line of the operation rod, and the powders may be filled inside the elastic elements.

According to this aspect, operability of the grip (the handle) for operating the power tool is improved while transmission of vibration to the grip of the power tool is prevented.

According to a further aspect of the power tool of the present invention, a tool bit as an accessory tool is coupled to a front end region of the tool body. The power tool is configured such that the tool bit performs a hammering operation on a workpiece by linear motion at least in its axial direction. The handle is disposed on the tool body on a side opposite from the tool bit. The handle has a connecting region which connects the handle to the tool body so as to allow the handle to move with respect to the tool body in the axial direction of the tool bit. Further, the elastic element interposing region and the powder filling region are formed in the connecting region.

According to this aspect, in the power tool in which the tool bit performs a hammering operation on a workpiece by linear motion at least in its axial direction, operability of the grip (the handle) for operating the power tool is improved while transmission of vibration to the grip of the power tool is prevented.

According to a further aspect of the power tool of the present invention, a tool bit is coupled to a front end region of the tool body. The power tool is configured such that the tool bit performs a hammering operation on a workpiece by linear motion at least in its axial direction. The handle is disposed on the tool body on a side opposite from the tool bit. The handle has two connecting regions which are spaced apart from each other in a direction crossing the axial direction of the tool bit and which connect the handle to the tool body so as to allow the handle to move with respect to the tool body in the axial direction of the tool bit. Further, the elastic element interposing region and the powder filling region are formed in at least one of the connecting regions. The elastic element interposing region and the powder filling region may be formed in both of the connecting regions of the handle.

According to this aspect, in the power tool in which the tool bit performs a hammering operation on a workpiece by linear motion at least in its axial direction and the handle is connected to the tool body at two points, operability of the grip (the handle) for operating the power tool is improved while transmission of vibration to the grip of the power tool is prevented.

Effect of the Invention

According to the present invention, a handle that is effective in achieving both vibration-proof property and operability is provided.

Other objects, features and advantages of the present invention will be readily understood after reading the following detailed description together with the accompanying drawings and the claims.

BEST MODES FOR CARRYING OUT THE INVENTION

Figure 1:
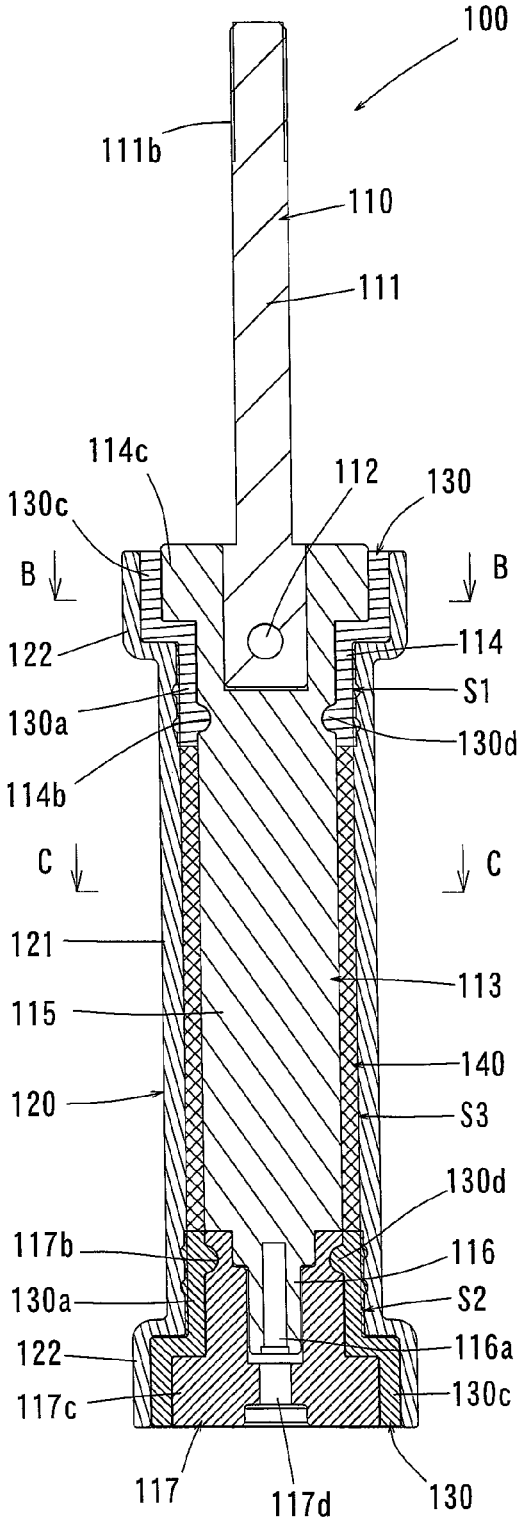
FIG. 1 is a sectional view showing the structure of a side grip according to a first embodiment of the present invention.

Each of the additional features and method steps disclosed above and below may be utilized separately or in conjunction with other features and method steps to provide improved handles, power tools and devices utilized therein. Representative examples of this invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

(First Embodiment of the Invention)

A first embodiment of the present invention is now described with reference to FIGS. 1 to 5, 11 and 12. In the first embodiment, a side grip 100 is explained which is mounted, for example, to an electric grinder 150 shown in FIG. 11 or a hammer drill shown in FIG. 12 as a representative example of a hand-held power tool according to the present invention.

The side grip 100 mainly includes a grip body 110 which is detachably connected to a tool body of a power tool, a grip part 120 to be held by a user, an elastic rubber 130 and powder 140. The grip body 110, the grip part 120, the elastic rubber 130 and the powder 140 are example embodiments that correspond to the "connection part", the "grip", the "elastic element" and the "powder", respectively, in the present invention.

Figure 2:
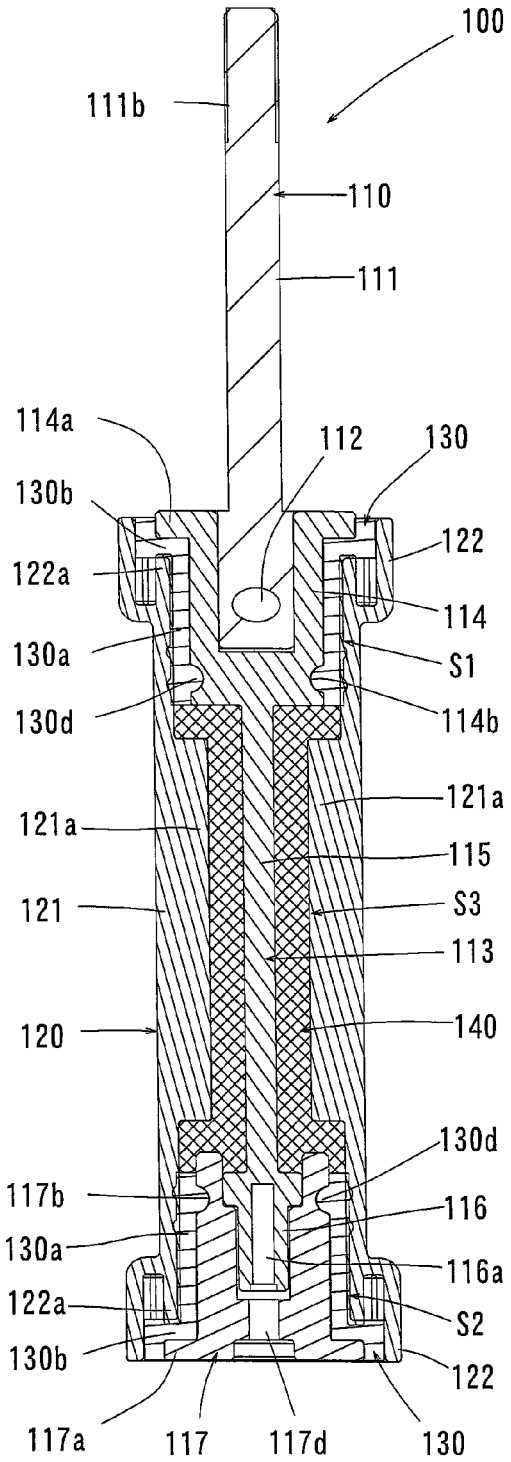
FIG. 2 is a sectional view taken along line A-A in FIG. 3.
Figure 3:
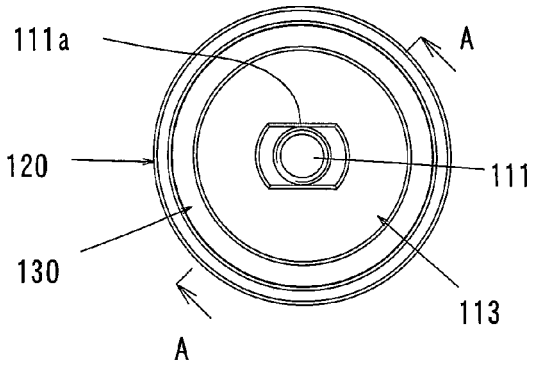
FIG. 3 is a plan view of the side grip.

As shown in FIGS. 1 and 2, the grip body 110 includes a metal mounting bolt 111 and a resin bolt holder 113 which are coaxially arranged. One end of the mounting bolt 111 and one end of the bolt holder 113 are joined by insert molding. A prescribed joining strength of the joint between the mounting bolt 111 and the bolt holder 113 is secured by forming a width across flat shank 111*a* (see FIG. 3) on one end of the mounting bolt 111 and by inserting an insert bolt 112 into the joint. The mounting bolt 111 has a threaded part 111*b* on the other end. The side grip 100 (the grip body 110) is mounted to the power tool by threadably engaging the threaded part 111*b* with a threaded hole of a body housing of the power tool.

Figure 4:
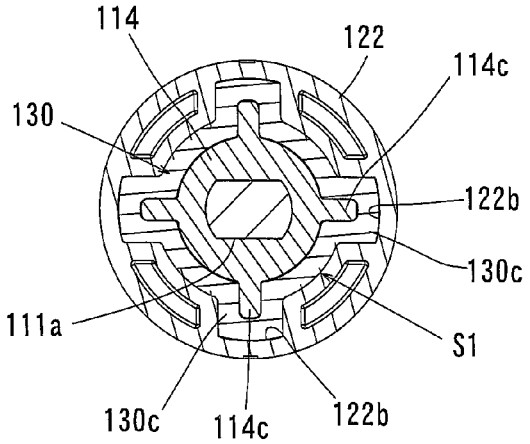
FIG. 4 is a sectional view taken along line B-B in FIG. 1.
Figure 5:
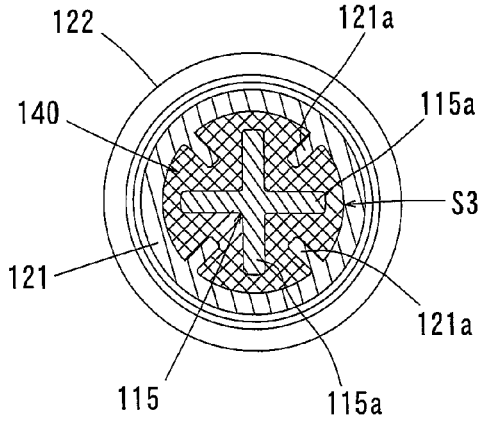
FIG. 5 is a sectional view taken along line C-C in FIG. 1.
Figure 6:
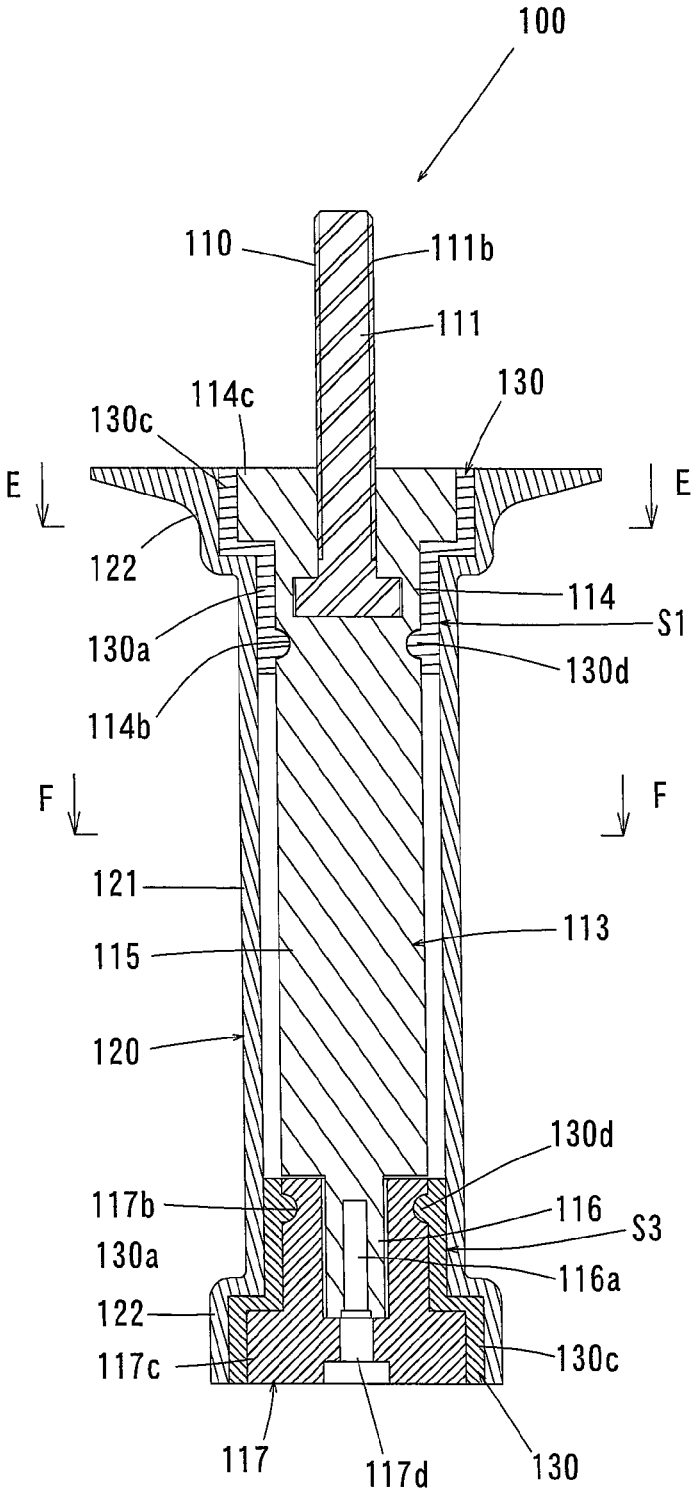
FIG. 6 is a sectional view showing the structure of a side grip according to a second embodiment of the present invention.

The bolt holder 113 is a linearly extending rod-like member having a predetermined length and has a circular large-diameter shank 114, a rod-like part 115 having a cross-shaped section and a circular small-diameter shank 116. The large-diameter shank 114, the rod-like part 115 and the small-diameter shank 116 are integrally and coaxially formed. Specifically, as shown in FIG. 2, the large-diameter shank 114 is formed on the tip side (the threaded part 111*b* side) of the mounting bolt 111 with respect to the rod-like part 115 in the longitudinal direction of the bolt holder 113, and the rod-like part 115 is formed between the large-diameter shank 114 and the small-diameter shank 116. The large-diameter shank 114 has a flange 114*a* extending outward (in the radial direction) on its end in the longitudinal direction. Further, an arcuate engagement groove 114*b* is formed in an outer periphery of the large-diameter shank 114 on the side opposite to the flange 114*a* in the longitudinal direction. Further, as shown in FIGS. 1 and 4, a plurality of (four in this embodiment) radially protruding rib-shaped projections 114*c* are formed contiguously to the back of the flange 114*a* at prescribed intervals in the circumferential direction on the outer surface of the large-diameter shank 114. As shown in FIG. 1, the projections 114*c* extend from the back of the flange 114*a* substantially to a middle region of the large-diameter shank 114 in the longitudinal direction. As shown in FIG. 5, the rod-like part 115 is formed by plate-like members 115*a* arranged in a cross shape.

As shown in FIGS. 1 and 2, an end cap 117 having a circular section is fitted on the small-diameter shank 116. As shown in FIG. 2, the end cap 117 has a flange 117*a* extending outward (in the radial direction) on its end in the longitudinal direction. Further, an arcuate engagement groove 117*b* is formed in an outer periphery of the end cap 117 on the side opposite to the flange 117*a* in the longitudinal direction. Further, as shown in FIG. 1, like in the large-diameter shank 114, a plurality of (four in this embodiment) radially protruding rib-shaped projections 117*c* are formed contiguously to the back of the flange 117*a* at prescribed intervals in the circumferential direction on the outer surface of the end cap 117. The projections 117*c* extend from the back of the flange 117*a* substantially to a middle region of the end cap 117 in the longitudinal direction.

As shown in FIGS. 1 and 2, the grip part 120 is a generally circular cylindrical member extending linearly with a prescribed length. The grip part 120 has a cylindrical part 121, and a large-diameter cylindrical part 122 integrally formed on each end of the cylindrical part 121 and having a larger outside diameter than the cylindrical part 121. As shown in FIG. 2, the large-diameter cylindrical part 122 has a stepped part 122*a* formed on its connection to the cylindrical part 121 and having the same inside diameter as the cylindrical part 121. An end region of the large-diameter cylindrical part 122 has a larger inside diameter than the cylindrical part 121. Specifically, the large-diameter cylindrical part 122 has a step substantially in its middle in the longitudinal direction.

Further, as shown in FIG. 4, a plurality of (four in this embodiment) recesses 122*b* recessed radially outward are formed at prescribed intervals in the circumferential direction in a region of the stepped part 122*a* in an inside region of the large-diameter cylindrical part 122 of the grip part 120. As shown in FIG. 5, a plurality of (four in this embodiment) inward protruding rib-shaped projections 121*a* are formed at prescribed intervals in the circumferential direction on the inside of the cylindrical part 121 of the grip part 120.

The grip part 120 is coaxially formed with the bolt holder 113. A prescribed clearance is formed between the inner surface of the grip part 120 and the outer surface of the bolt holder 113. As shown in FIG. 4, the projections 114*c* of the large-diameter shank 114 of the bolt holder 113 are arranged in the middle of the recesses 122*b* in the circumferential direction in one of the large-diameter cylindrical parts 122.

Similarly, the projections 117*c* of the end cap 117 are arranged in the middle of the recesses 122*b* in the circumferential direction in the other large-diameter cylindrical part 122. Further, as shown in FIG. 5, part of the rod-like part 115 of the bolt holder 113 is arranged between tip ends of the projections 121*a* of the cylindrical part 121 in the circumferential direction.

By coaxially arranging the grip part 120 on the outside of the bolt holder 113, a prescribed clearance is formed between the inner surface of the grip part 120 and the outer surface of the bolt holder 113 and between the inner surface of the grip part 120 and the outer surface of the end cap 117. Specifically, as shown in FIGS. 1, 2 and 4, a first space S1 is formed between the outer surface of the large-diameter shank 114 including the flange 114*a*, the engagement groove 114*b* and the projections 114*c*, and the inner surface of the one large-diameter cylindrical part 122 including the recesses 122*b* and the inner surface of the end region of the cylindrical part 121. As shown in FIGS. 1 and 2, a second space S2 is formed between the outer surface of the end cap 117 including the flange 117*a*, the engagement groove 117*b* and the projections 117*c*, and the inner surface of the other large-diameter cylindrical part 122 including the recesses 122*b* and the inner surface of the end region of the cylindrical part 121. The first space S1 and the second space S2 are provided as a rubber arrangement space for the elastic rubber 130. The first space S1 and the second space S2 are an example embodiment that corresponds to the "elastic element interposing region" in the present invention.

A third space S3 is formed between the outer peripheral surface of the rod-like part 115 of the bolt holder 113 and the inner surface of the cylindrical part 121 including the projections 121*a*. The third space S3 is provided as a powder filling space for the powder 140. The third space S3 is an example embodiment that corresponds to the "powder filling region" in the present invention.

The first, second and third spaces S1, S2, S3 are arranged side by side in the longitudinal direction (crossing the radial direction from the bolt holder 113 toward the grip part 120) of the side grip 100. The elastic rubber 130 is disposed in the first and second spaces S1, S2, and the powder 140 is disposed in the third space S3. The elastic rubber 130 disposed in the first space S1 is shaped to correspond to the shape of the first space S1. Similarly, the elastic rubber 130 disposed in the second space S2 is shaped to correspond to the shape of the second space S2.

Specifically, as shown in FIGS. 1, 2 and 4, the elastic rubber 130 disposed in the first space S1 nearer to the mounting bolt 111 has a cylindrical part 130*a* interposed between the outer surface of the large-diameter shank 114 of the bolt holder 113 and the inner surface of the grip part 120 in the radial direction, a stepped part 130*b* interposed between the flange 114*a* of the large-diameter shank 114 and the stepped part 122*a* of the large-diameter cylindrical part 122 of the grip part 120 in the longitudinal direction, and radially protruding parts 130*c* interposed between the projections 114*c* of the large-diameter shank 114 and the recesses 122*b* of the large-diameter cylindrical part 122 in the circumferential direction.

Further, as shown in FIGS. 1 and 2, the elastic rubber 130 disposed in the second space S2 far from the mounting bolt 111 has a cylindrical part 130*a* interposed between the outer surface of the end cap 117 and the inner surface of the grip part 120 opposed to the outer surface of the end cap 117 in the radial direction, a stepped part 130*b* interposed between the flange 117*a* of the end cap 117 and the stepped part 122*a* of the large-diameter cylindrical part 122 of the grip part 120 in the longitudinal direction, and radially protruding parts 130*c* interposed between the projections 117*c* of the end cap 117 and the recesses 122*b* of the large-diameter cylindrical part 122 in the circumferential direction.

When a force of moving the grip part 120 and the bolt holder 113 with respect to each other is applied to the grip part 120 and the bolt holder 113, the elastic rubbers 130 disposed in the first space S1 and the second space S2 allow the relative movement of the grip part 120 and the bolt holder 113 by elastically deforming or mainly by compressively deforming in all of the radial, longitudinal and circumferential directions of the side grip 100. Specifically, the grip part 120 is connected to the bolt holder 113 via the elastic rubbers 130 such that the grip part 120 can move with respect to the bolt holder 113 in the three directions, or the radial, longitudinal and circumferential directions of the side grip 100.

When the protruding parts 130*c* of the elastic rubber 130 interposed between the projections 114*c* of the large-diameter shank 114 and the recesses 122*b* of the large-diameter cylindrical part 122 and the protruding parts 130*c* of the elastic rubber 130 interposed between the projections 117*c* of the end cap 117 and the recesses 122*b* of the large-diameter cylindrical part 122 are compressively deformed, the grip part 120 is prevented from rotating with respect to the bolt holder 113 in the circumferential direction. Thus, the projections 114*c*, 117*c*, the recesses 122*b* and the protruding parts 130*c* of the elastic rubbers 130 form the "rotation stopper" in the present invention.

The elastic rubber 130 disposed in the first space S1 has an engagement part 130*d* formed on the inner circumferential surface of the cylindrical part 130*a* and engaged with the groove 114*b* of the large-diameter shank 114, so that relative movement of the elastic rubber 130 and the large-diameter shank 114 in the longitudinal direction is prevented. Similarly, the elastic rubber 130 disposed in the second space S2 has an engagement part 130*d* formed on the inner circumferential surface of the cylindrical part 130*a* and engaged with the engagement groove 117*b* of the end cap 117, so that relative movement of the elastic rubber 130 and the end cap 117 in the longitudinal direction is prevented. Further, the grip part 120 is arranged between the stepped parts 130*b* of the both elastic rubbers 130 in the longitudinal direction, so that the elastic rubbers 130 and the grip part 120 are prevented from moving with respect to each other in the longitudinal direction.

The third space S3 is filled with powders 140. The powders 140 are an assembly of powders or granules. For example, powders such as sand, cement and wheat flour, and magnetic fine powder or toner are suitably used.

The powders 140 in the third space S3 are interposed between the inner surface of the cylindrical part 121 of the grip part 120 and the outer surface of the rod-like part 115 of the bolt holder 113 opposed to the inner surface of the cylindrical part 121, and as shown in FIG. 1, interposed between ends of the rib-shaped projections 121*a* of the cylindrical part 121 in the extending direction and an inner end of the large-diameter shank 114 in the longitudinal direction. Further, as shown in FIG. 5, the powders 140 are interposed between side surfaces of the projections 121*a* of the cylindrical part 121 and the plate-like members 115*a* of the rod-like part 115 of the bolt holder 113 opposed to the side surfaces of the projections 121*a*. Specifically, the powders 140 are disposed (filled) between the bolt holder 113 and the grip part 120 in the three directions, or the radial, longitudinal and circumferential directions of the side grip 100. The projections 121*a*, the plate-like members 115*a* and the powders 140 interposed between the projections 121*a* and the plate-like members 115*a* prevent the grip part 120 from rotating with respect to the bolt holder 113 in the circumferential direction. The projections 121*a*, the plate-like members 115*a* and the powders 140 interposed therebetween form the "rotation stopper" in the present invention.

The powders 140 are filled when the side grip 100 is assembled. Specifically, the grip part 120 is moved in the longitudinal direction toward the bolt holder 113 with the elastic rubber 130 fitted on the large-diameter shank 114 in advance, and one end of the grip part 120 is fitted onto the elastic rubber 130 around the large-diameter shank 114. Subsequently, the powders 140 are filled from the other end of the grip part 120. After filling the powders 140, the end cap 117 having the elastic rubber 130 fitted thereon in advance is inserted into the other end part of the grip part 120 and fitted in the grip part 120 and on the small-diameter shank 116 of the bolt holder 113. Thereafter, the end cap 117 is fixed by threadably engaging a set screw (not shown) with a threaded hole 116*a* of the small-diameter shank 116 through a through hole 117*d* of the end cap 117. Further, a clearance between the outer circumferential surface of the cylindrical part 130*a* of the elastic rubber 130 and the inner circumferential surface of the cylindrical part 121 of the grip part 120 is sealed by a sealing material such as an adhesive, so that the powders 140 are prevented from flowing out of the side grip.

Figure 11:
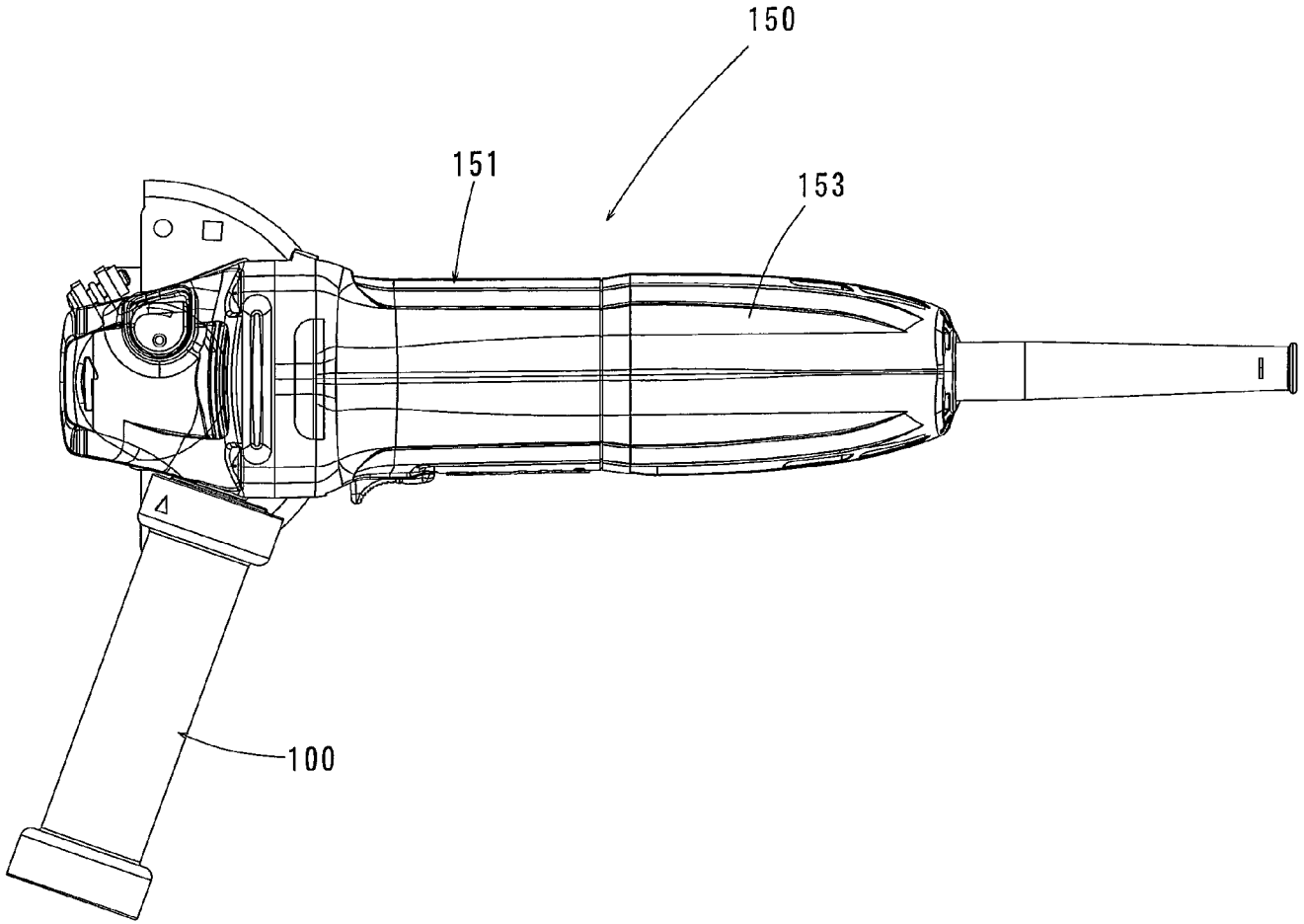
FIG. 11 is an explanatory drawing for showing an example of application of the side grip to an electric grinder.
Figure 12:
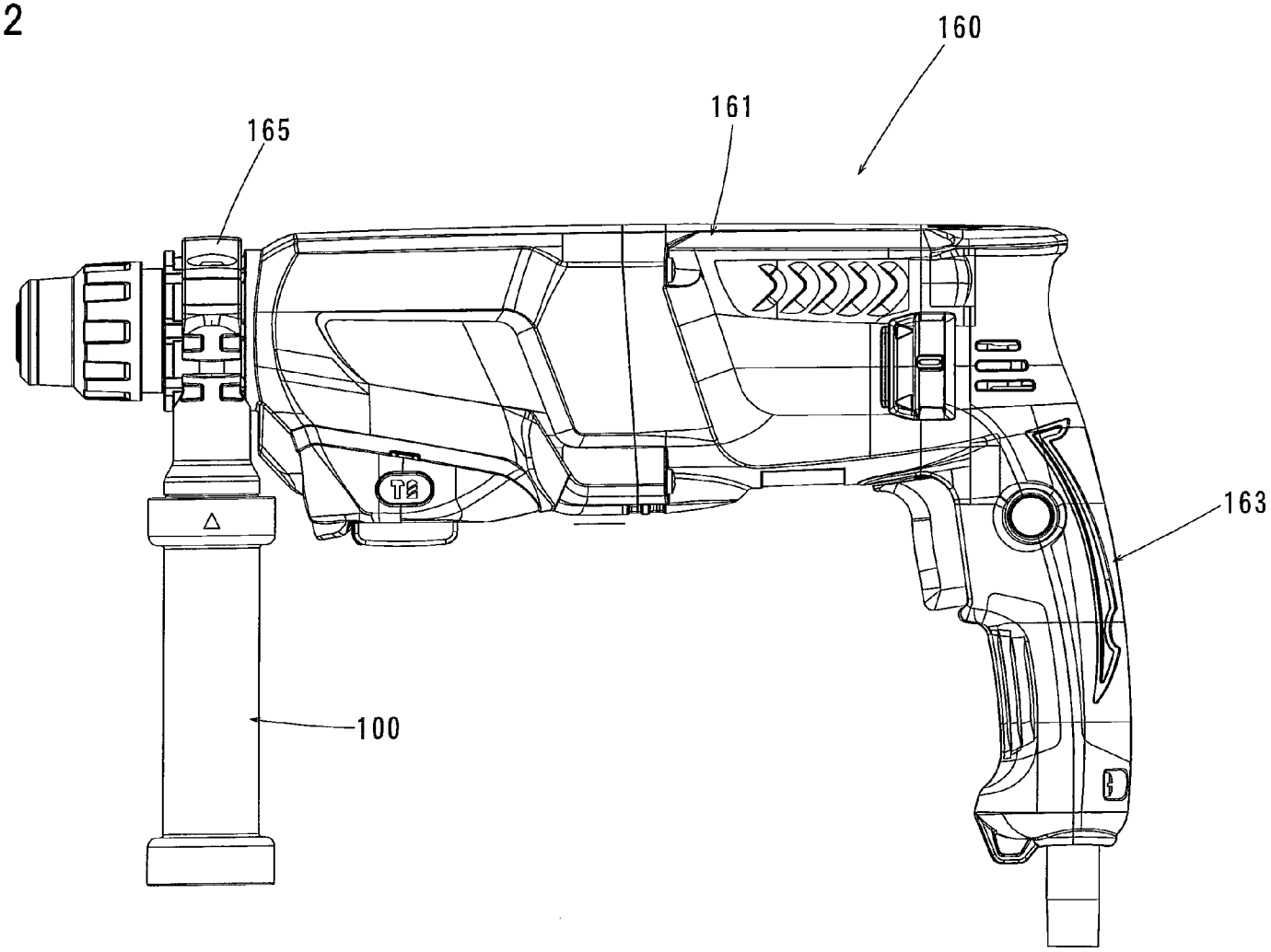
FIG. 12 is an explanatory drawing for showing an example of application of the side grip to a hammer drill.

The side grip 100 of the first embodiment is applied to an electric grinder 150 shown in FIG. 11 or a hammer drill 160 shown in FIG. 12 as a hand-held power tool.

As shown in FIG. 11, the electric grinder 150 has a generally cylindrical body housing 151, and a grinding wheel (not shown) as an accessory tool is attached to a front end region (on the left as viewed in FIG. 11) of the body housing 151 in the longitudinal direction. The body housing 151 is an example embodiment that corresponds to the "tool body" in the present invention. A region of the body housing 151 on the side opposite to the accessory tool side is set as a main grip part 153 to be held by a user. The side grip 100 is attached to the front end region side of the body housing 151. Specifically, a grip mounting part having a threaded hole is provided on the front end region side of the body housing 151, and the side grip 100 is attached to the electric grinder 150 by threadably engaging the threaded part 111*b* of the mounting bolt 111 with the threaded hole of the grip mounting part. The user holds the main grip part 153 and the side grip 100 and performs a grinding operation.

As shown in FIG. 12, in the hammer drill 160, a hammer bit (not shown) as the accessory tool is mounted to the front end region of a body housing 161. A hand grip 163 is provided as a main handle on the side of the body housing 161 opposite to the hammer bit and extends in a direction crossing the longitudinal direction of the body housing 161. The body housing 161 is an example embodiment that corresponds to the "tool body" in the present invention. The side grip 100 is attached to the front end region side of the body housing 161 via a detachable ring-like mounting member 165. Specifically, the side grip 100 is attached by threadably engaging the threaded part 111*b* of the mounting bolt 111 with a threaded hole of the ring-like mounting member 165. The user holds the hand grip 163 and the side grip 100 and performs a drilling operation.

When performing an operation with the electric grinder 150 or the hammer drill 160 while holding the side grip 100, the grip body 110 vibrates together with the body housing 151 or 161. In the side grip 100, the elastic rubber 130 interposed between the bolt holder 113 of the grip body 110 and the grip part 120 elastically deforms according to the vibration of the bolt holder 113. As a result, transmission of vibration to the grip part 120 is reduced.

Specifically, as for vibration in the radial direction crossing the longitudinal direction of the side grip 100 (vibration in the longitudinal direction of the body housing 151 or 161), transmission of vibration to the grip part 120 is reduced by compressive deformation of the cylindrical part 130*a* of the elastic rubber 130 interposed between the large-diameter shank 114 and the grip part 120 and between the end cap 117 and the grip part 120. Further, as for vibration in the longitudinal direction of the side grip 100, transmission of vibration to the grip part 120 is reduced by compressive deformation of the stepped part 130*b* of the elastic rubber 130 interposed between the flange 114*a* of the large-diameter shank 114 and the stepped part 122*a* of the large-diameter cylindrical part 122 and between the flange 117*a* of the end cap 117 and the stepped part 122*a* of the large-diameter cylindrical part 122. As for vibration in the circumferential direction around the axis of the side grip 100, transmission of vibration to the grip part 120 is reduced by compressive deformation of the protruding parts 130*c* of the elastic rubber 130 interposed between the projections 114*c* of the large-diameter shank 114 and the recesses 122*b* of the grip part 120 and between the projections 117*c* of the end cap 117 and the recesses 122*b* of the grip part 120.

The powders 140 contact each other and repeat micro vibration in response to vibration of the grip body 110 which is caused by vibration of the body housing 151 or 161. At this time, kinetic energy of vibration of the body 110 is consumed by frictional resistance between the powders, so that vibration is reduced. As a result, transmission of vibration to the grip part 120 is reduced. Specifically, in the side grip 100, the effect of reducing transmission of vibration is enhanced by reducing the hardness or the spring constant of the elastic rubber 130, and transmission of vibration is also reduced by flow of the powders 140. Thus, transmission of vibration caused in the bolt holder 113 is reduced by the elastic rubber 130 and the powders 140. As a result, transmission of vibration from the bolt holder 113 to the grip part 120 is effectively reduced.

The acceleration generated when a user holds the side grip 100 and actuates the electric grinder 150 or the hammer drill 160 is smaller than the acceleration of vibration caused in the body housing 151 or 161 during operation. Therefore, the power inputted into the grip part 120 held by the user is received by the powders 140. Thus, the powders 140 serve to enhance the rigid feeling of the connection between the bolt holder 113 and the grip part 120 and prevent wobble of the grip part 120. As a result, operability for the user holding the grip part 120 is improved. With the structure in which the powders 140 are disposed between the bolt holder 113 including the end cap 117 and the grip part 120 in the three directions, or the radial, longitudinal and circumferential directions of the side grip 100, the powders 140 effectively act upon the user's power inputted into the grip part 120 in any of the three directions.

As described above, the side grip 100 of the first embodiment ensures the vibration-proof property of the grip part 120 and improves the operability for operating the electric grinder 150 or the hammer drill 160.

Further, according to the first embodiment, the entire region of the elastic rubber 130 in the circumferential direction is interposed between the inner surface of the cylindrical part 121 of the grip part 120 and the outer surface of the large-diameter shank 114 of the bolt holder 113, and between the inner surface of the cylindrical part 121 of the grip part 120 and the outer surface of the end cap 117. Further, the entire region of the powders 140 in the circumferential direction is interposed between the inner surface of the cylindrical part 121 of the grip part 120 and the outer surface of the rod-like part 115 of the bolt holder 113. Therefore, the elastic rubber 130 and the powders 140 reduce vibration which is caused in a plurality of directions and transmitted from the body housing 151 or 161 to the grip part 120 via the grip body 110 in the radial direction of the grip part 120. In the case of the electric grinder 150 shown in FIG. 11, for example, the longitudinal direction (the vertical direction in FIG. 11) and the vertical direction (a direction perpendicular to the paper plane of FIG. 11) of the electric grinder 150 correspond to the "first direction" and the "second direction", respectively, in the present invention. In the case of the hammer drill 160 shown in FIG. 12, the longitudinal direction (the horizontal direction in FIG. 12) and the transverse direction (a direction perpendicular to the paper plane of FIG. 12) of the hammer drill 160 correspond to the "first direction" and the "second direction", respectively, in the present invention.

Further, according to the first embodiment, the elastic rubber 130 is interposed between the projections 114*c* of the large-diameter shank 114 and the recesses 122*b* of the large-diameter cylindrical part 122 and between the projections 117*c* of the end cap 117 and the recesses 122*b* of the large-diameter cylindrical part 122. Further, the powders 140 are interposed between the projections 121*a* of the cylindrical part 121 and the plate-like members 115*a* of the rod-like part 115. With this structure, the grip part 120 is prevented from rotating with respect to the bolt holder 113 in the circumferential direction. When attaching the side grip 100 to the body housing 151 or 161 by threadably engaging the threaded part 111*b* of the mounting bolt 111 with the threaded hole of the body housing 151 or 161 of the electric grinder 150 or the hammer drill 160, rotation of the grip part 120 is reliably transmitted to the threaded part 111*b*. Therefore, attachment and detachment of the side grip 100 can be reliably achieved.

In the first embodiment, when the grip mounting part of the electric grinder 150 has a different shape from the grip mounting part of the hammer drill 160, the length or diameter of the mounting bolt 111 is adjusted in advance to correspond to the shapes of the grip mounting parts.

Further, in the first embodiment, each of the elastic rubbers 130 and the powders 140 are arranged over the entire region of the bolt holder 113 in the circumferential direction around the axis of the bolt holder 113, but the arrangement is not limited to this. For example, a plurality of the elastic rubbers 130 and/or the powders 140 may be arranged at prescribed intervals in the circumferential direction of the bolt holder 113.

Further, in the first embodiment, the elastic rubber 130 and the powders 140 are arranged side by side in a direction (the longitudinal direction of the side grip 100) crossing a direction (the radial direction) from the bolt holder 113 toward the grip part 120, but the arrangement is not limited to this. For example, the elastic rubber 130 and the powders 140 may be arranged side by side in the direction (the radial direction) from the bolt holder 113 toward the grip part 120.

(Second Embodiment of the Invention)

The side grip 100 according to a second embodiment of the present invention is now described with reference to FIGS. 6 to 10. The second embodiment is different from the first embodiment in the manner of filling the powders 140. The powders 140 are filled and sealed in advance in a tube-like bag 141 formed of a flexible material such as rubber, cloth and vinyl. The bag 141 filled with the powders 140 is disposed in the space between the inner surface of the cylindrical part 121 of the grip part 120 and the outer surface of the rod-like part 115 of the bolt holder 113. In the other points, this embodiment has substantially the same structure as the first embodiment. Components or elements in the second embodiment which are substantially identical to those in the first embodiment are given like numerals as in the first embodiment and will not be described. The tube-like bag 141 is an example embodiment that corresponds to the "bag" in the present invention.

Figure 10:
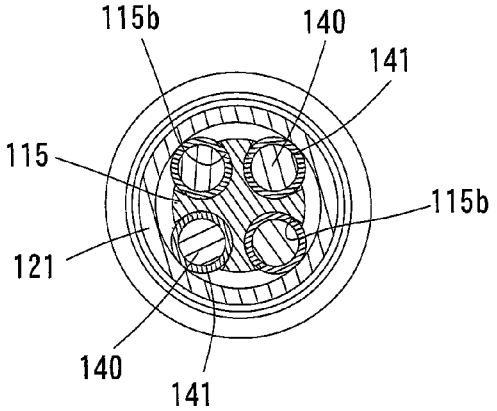
FIG. 10 is a sectional view taken along line F-F in FIG. 6.

As shown in FIG. 10, the rod-like part 115 of the bolt holder 113 is generally cylindrically formed and has a plurality of (four in this embodiment) housing grooves 115*b* having an arcuate section and extending in parallel to the longitudinal direction of the rod-like part 115. The housing grooves 115*b* are configured as powder arrangement space and formed at prescribed intervals in the circumferential direction of the rod-like part 115. The housing groove 115*b* is an example embodiment that corresponds to the "powder filling region" in the present invention. One end of each of the housing grooves 115*b* on the large-diameter shank 114 side in the longitudinal direction is closed by the large-diameter shank 114. The other end of the housing groove 115*b* on the small-diameter shank 116 side in the longitudinal direction is open in the longitudinal direction. The bag 141 filled with the powders 140 is generally cylindrically formed and is inserted into each of the housing grooves 115*b* from the open end on the small-diameter shank 116 side and held therein.

The housing groove 115*b* has a generally semi-circular arc shape. Therefore, as shown in FIG. 10, the bag 141 disposed in the housing groove 115*b* is held so as to partially protrude on the outer surface of the rod-like part 115 from the housing groove 115*b*. The part of the bag 141 protruding from the rod-like part 115 is held in contact with the inner surface of the cylindrical part 121 of the grip part 120.

Figure 7:
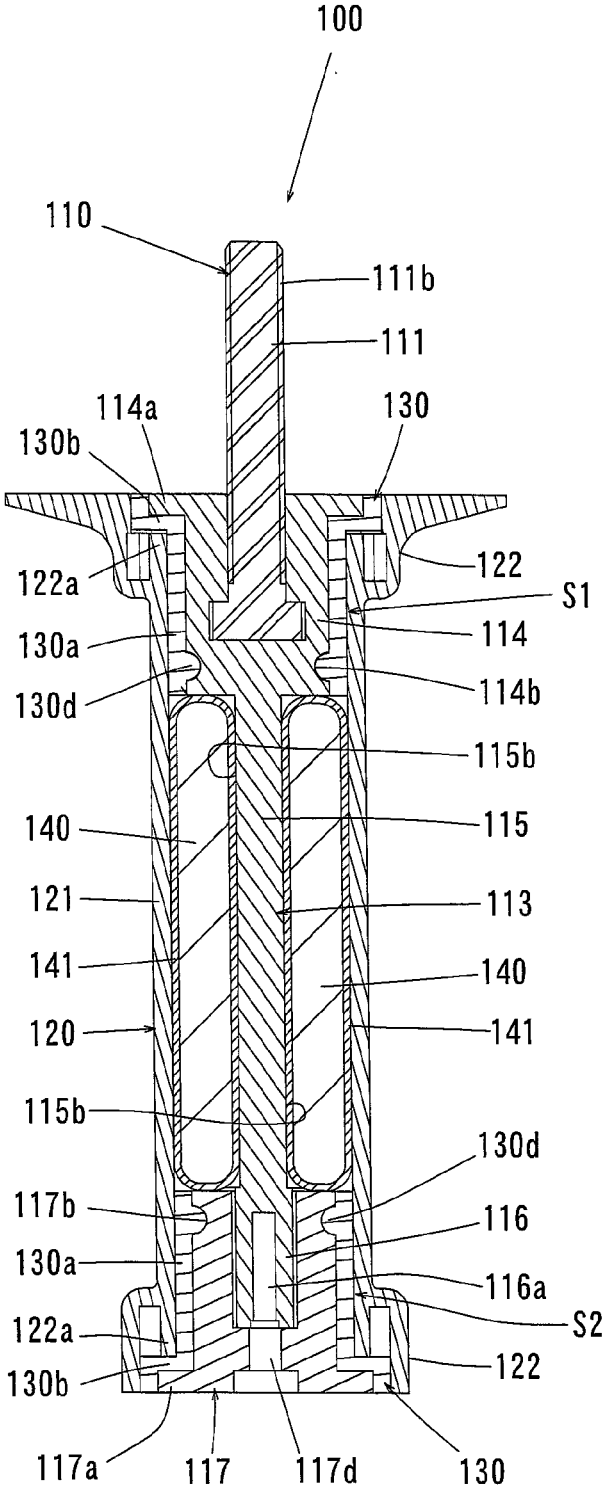
FIG. 7 is a sectional view taken along line D-D in FIG. 8.
Figure 8:
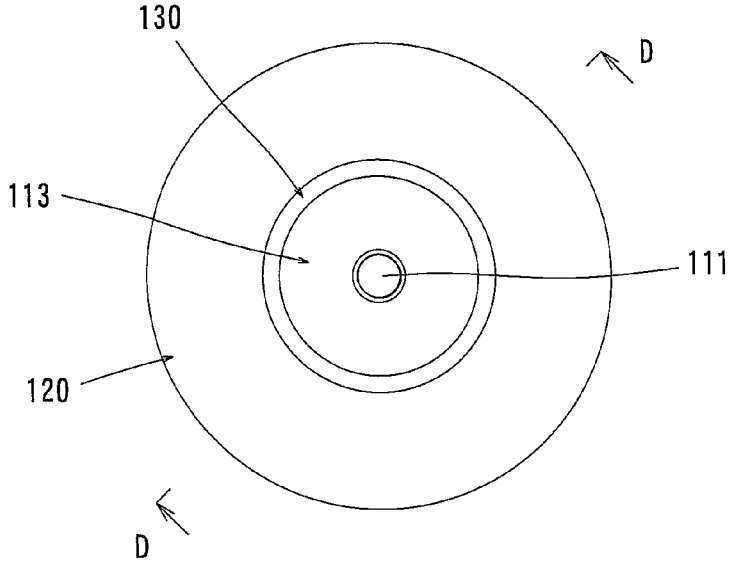
FIG. 8 is a plan view of the side grip.
Figure 9:
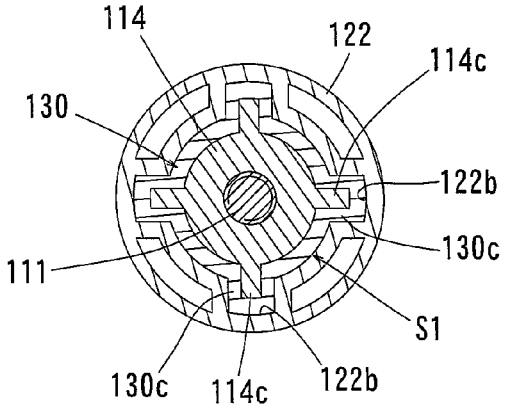
FIG. 9 is a sectional view taken along line E-E in FIG. 6.

In the final process of assembling the side grip 100, as shown in FIG. 7, the bag 141 filled with the powders 140 is disposed in the space between the inner surface of the cylindrical part 121 of the grip part 120 and the outer surface of the rod-like part 115 of the bolt holder 113 by inserting and fitting the end cap 117 on which the elastic rubber 130 is fitted in advance into the other end part of the grip part 120. The end cap 117 is fixed to the bolt holder 113 by threadably engaging a set screw (not shown) with the threaded hole 116*a* of the small-diameter shank 116 through the through hole 117*d* of the end cap 117.

Like in the first embodiment, the side grip 100 according to the second embodiment is mounted to an electric grinder 150 shown in FIG. 11 or a hammer drill 160 shown in FIG. 12 as a hand-held power tool. Like in the first embodiment, the side grip 100 of this embodiment ensures the vibration-proof property of the grip part 120 and improves the operability for operating the electric grinder 150 or the hammer drill 160.

Further, according to the second embodiment, the powders 140 filled in the bag 141 formed of a flexible material such as rubber, cloth and vinyl are inserted into the housing grooves 115*b* of the rod-like part 115. Therefore, the powders 140 can be easily arranged in the space between the inner surface of the cylindrical part 121 of the grip part 120 and the outer surface of the rod-like part 115 of the bolt holder 113. Therefore, the assembling operation of the side grip 100 is simplified.

In the second embodiment, the powders 140 are arranged at prescribed intervals in the circumferential direction of the bolt holder 113, but the arrangement is not limited to this. For example, the powders 140 may be arranged continuously over the entire region of the bolt holder 113 in the circumferential direction.

(Third Embodiment of the Invention)

Figure 13:
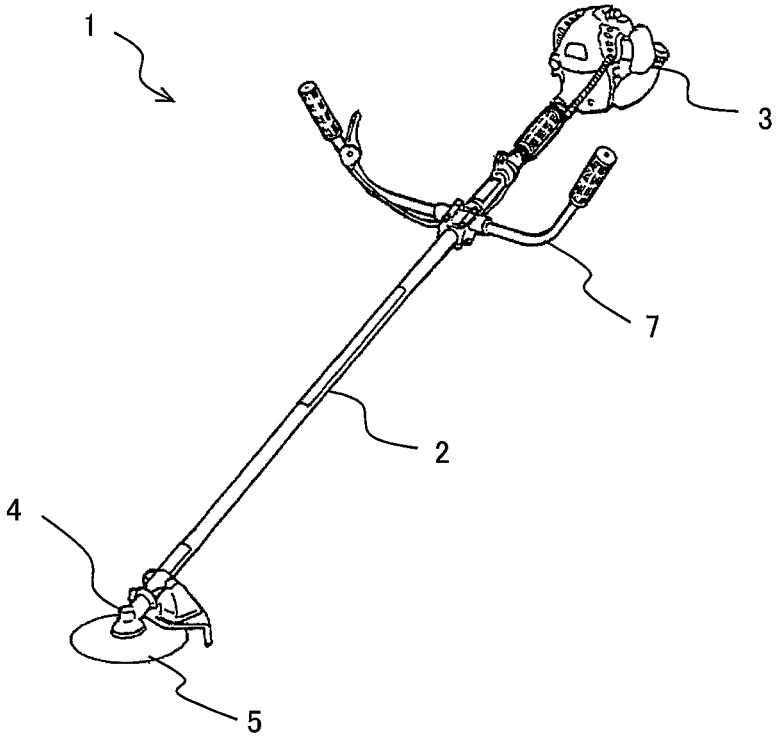
FIG. 13 is an external view showing the structure of a bush cutter having a handle according to a third embodiment of the present invention.
Figure 14:
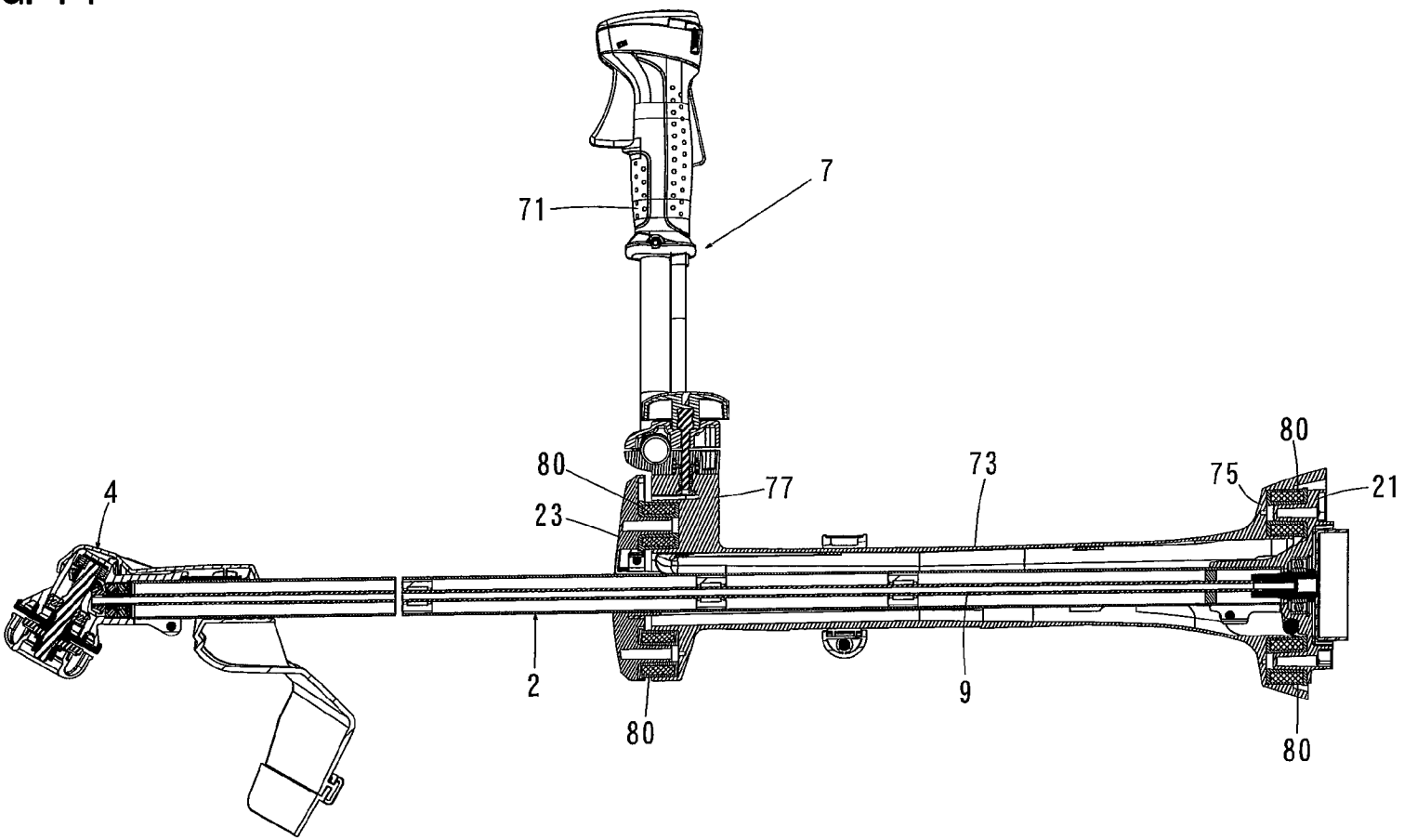
FIG. 14 is a sectional view showing the structure of mounting the handle to an operation rod.

A third embodiment of the present invention is now described with reference to FIGS. 13 to 18. In the third embodiment, the present invention is applied to a handle of a bush cutter. As shown in FIG. 13, a bush cutter 1 includes an operation rod 2, a power unit 3 mounted to one end of the operation rod 2, a cutting unit 4 provided on the other end of the operation rod 2, and a generally U-shaped handle 7 mounted to a middle of the operation rod 2 and protruding in a direction crossing the extending direction of the operation rod 2. A cutting blade 5 as an accessory tool is rotatably held by the cutting unit 4. The power unit 3 has an engine (not shown) for driving the cutting blade 5. As shown in FIG. 14, the output of the engine is transmitted as rotating motion to the cutting blade 5 via a rotary shaft 9 extending within the operation rod 2. The operation rod 2, the power unit 3, the cutting unit 4 and the handle 7 are example embodiments that correspond to the "operation rod", the "driving unit", the "cutting unit" and the "handle", respectively, in the present invention.

Figure 15:
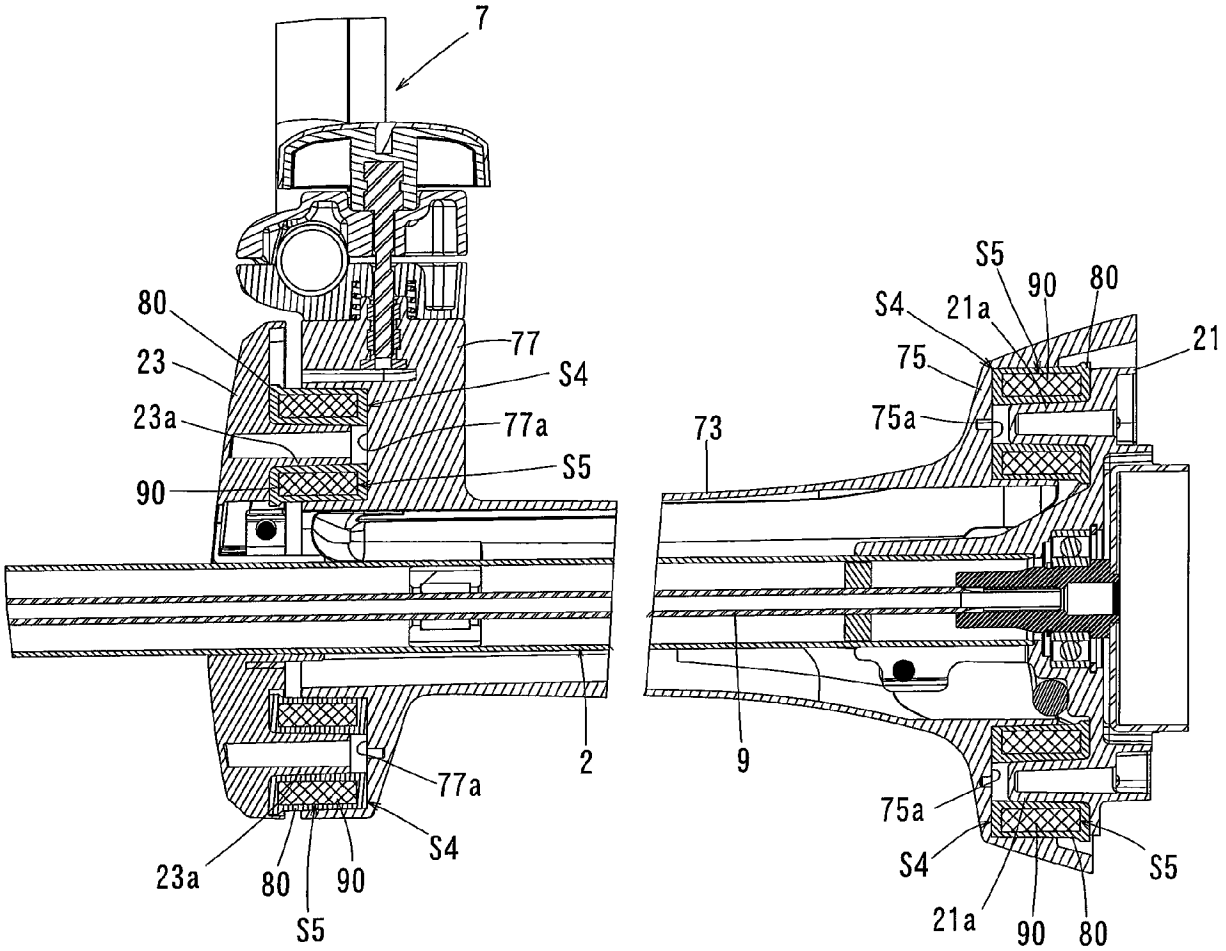
FIG. 15 is an enlarged sectional view of part of FIG. 14.

As shown in FIGS. 14 and 15, two support parts 21, 23 are provided on the operation rod 2 with prescribed spacing in the longitudinal direction of the operation rod 2 in order to mount the handle 7 onto the operation rod 2. The support parts 21, 23 are formed as flange-like members. The support part 21 formed on the end of the operation rod 2 on the power unit 3 side also serves as a connection member for connecting the operation rod 2 to the power unit 3.

As shown in FIG. 14, the handle 7 mainly includes a grip part 71 to be held by a user, an elastic rubber 80 and powders 90. The handle 7 has a cylindrical member 73 having a generally circular section and integrally connected to the grip part 71. The grip part 71 is an example embodiment that corresponds to the "grip" in the present invention. As shown in FIG. 15, the cylindrical member 73 is coaxially disposed on the outside of the operation rod 2 between the support parts 21, 23 of the operation rod 2. A flange-like connecting part 75 is formed on one end of the cylindrical member 73 in the longitudinal direction and opposed to the support part 21 of the operation rod 2 in the longitudinal direction. Further, a flange-like connecting part 77 is formed on the other end of the cylindrical member 73 and opposed to the other support part 23 of the operation rod 2 in the longitudinal direction. The connecting parts 75, 77 are connected to the support parts 21, 23, respectively, via a plurality of (four each in this embodiment) elastic rubbers 80 disposed at prescribed intervals around the center line of the operation rod 2 at positions offset from the center line. The elastic rubber 80 is an example embodiment that corresponds to the "elastic element" in the present invention.

As shown in FIG. 15, a plurality of cylindrical recesses 75*a*, 77*a* are formed at prescribed intervals in the circumferential direction of the cylindrical member 73 in the surfaces of the connecting parts 75, 77 of the cylindrical member 73 which are opposed to the support parts 21, 23. Further, cylindrical shaft-like projections 21*a*, 23*a* are formed at prescribed intervals around the axis of the operation rod 2 on the surfaces of the support parts 21, 23 which are opposed to the connecting parts 75, 77, so as to correspond to the recesses 75*a*, 77*a*.

Figure 16:
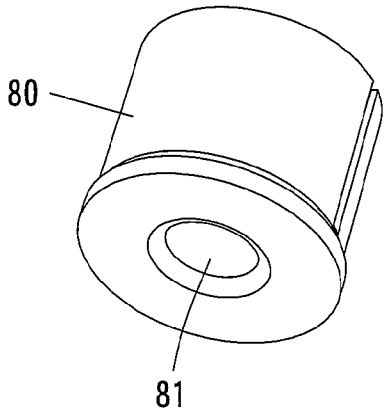
FIG. 16 is an external view of an elastic rubber unit.
Figure 17:
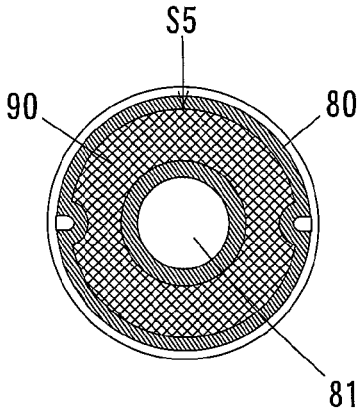
FIG. 17 is a cross-sectional view of the elastic rubber unit.
Figure 18:
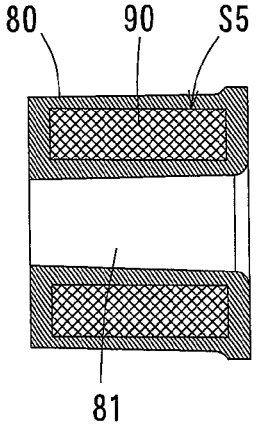
FIG. 18 is a longitudinal section of the elastic rubber unit.

As shown in FIGS. 16 to 18, each of the elastic rubbers 80 has a cylindrical shape having a mounting hole 81 in the center. The powders 90 are filled and sealed in the elastic rubber 80. Specifically, the elastic rubber 80 has a cylindrical space S5 continuously extending in the circumferential direction of the elastic rubber 80 and filled with the powders 90. The cylindrical space S5 of the elastic rubber 80 and the powder 90 are example embodiments that correspond to the "powder filling region" and the "powder", respectively, according to the present invention. As shown in FIG. 15, the elastic rubbers 80 are fixedly fitted in the cylindrical recesses 75*a*, 77*a* of the connecting parts 75, 77. Further, the projections 21*a*, 23*a* of the support parts 21, 23 are fixedly fitted in the mounting holes 81 of the elastic rubbers 80. Therefore, the elastic rubbers 80 and the powders 90 are arranged along a direction (the longitudinal direction of the operation rod 2) from the support parts 21, 23 toward the cylindrical member 73. A cylindrical space S4 between the cylindrical recesses 75*a*, 77*a* of the connecting parts 75, 77 and the projections 21*a*, 23*a* of the support parts 21, 23 is an example embodiment that corresponds to the "elastic element interposing region" in the present invention. Further, the inner circumferential surface of the mounting hole 81 of the elastic rubber 80 is an example embodiment that corresponds to the "connection part" in the present invention.

As shown in FIG. 15, the support part 21 of the operation rod 2 close to the power unit 3 is formed integrally with the operation rod 2. The support part 23 far from the power unit 3 is formed separately from the operation rod 2. After the cylindrical member 73 of the handle 7 is assembled onto the operation rod 2, the support part 23 is mounted onto the operation rod 2. Further, the grip part 71 to be held by a user is connected to the connecting part 77 of the cylindrical member 73 far from the power unit 3.

During bush cutting of weeds or small-diameter woods by the bush cutter 1, the operation rod 2 vibrates by driving of the power unit 3 or cutting operation of the cutting unit 4. The elastic rubbers 80 reduce transmission of vibration to the grip part 71 by elastically deforming in response to the vibration of the operation rod 2. Specifically, as for vibration in radial directions crossing the longitudinal direction of the operation rod 2 or in the vertical and transverse directions, and vibration in a rotational direction around the axis of the operation rod 2, transmission of vibration to the grip part 71 is reduced by elastic deformation (compressive deformation) of regions of the elastic rubbers 80 which are interposed between the inner circumferential walls of the recesses 75*a*, 77*a* of the connecting parts 75, 77 and the outer circumferential surfaces the projections 21*a*, 23*a* of the support parts 21, 23, respectively. Further, as for vibration in the longitudinal direction of the operation rod 2 or in the longitudinal direction, transmission of vibration to the grip part 71 is reduced by elastic deformation (compressive deformation) of regions of the elastic rubbers 80 which are interposed between the bottoms of the recesses 75*a*, 77*a* and the side surfaces of the support parts 21, 23 opposed to the bottoms of the recesses 75*a*, 77*a*, respectively. The radial direction crossing the longitudinal direction of the operation rod 2 and the longitudinal direction of the operation rod 2 are example embodiments that correspond to the "first direction" and the "second direction", respectively, in the present invention.

The powders 90 in the elastic rubber 80 contact each other and repeat micro vibration in response to vibration of the operation rod 2. At this time, kinetic energy of vibration of the operation rod 2 is consumed by frictional resistance between the powders, so that vibration is reduced. As a result, transmission of vibration to the grip part 71 is reduced. Thus, transmission of vibration caused in the operation rod 2 is reduced by the elastic rubbers 80 and the powders 90. As a result, transmission of vibration from the operation rod 2 to the handle 7 is effectively reduced.

The acceleration generated when a user holds the grip part 71 and actuates the bush cutter 1 is smaller than the acceleration of vibration caused in the operation rod 2 during bush cutting operation. Therefore, the power inputted into the handle 7 held by the user is received by the powders 90. Thus, the powders 90 serve to enhance the rigid feeling of the connection between the operation rod 2 and the cylindrical member 73 and prevent wobble of the cylindrical member 73. As a result, operability for the user holding the handle 7 is improved. With the structure in which the powders 90 are filled in the elastic rubbers 80 and disposed between the support parts 21, 23 and the connecting parts 75, 77 in the three directions, or the longitudinal direction of the operation rod 2, the radial direction crossing the longitudinal direction, and the circumferential direction around the axis of the operation rod 2, the powders 90 effectively act upon the user's power inputted into the handle 7 in any of the three directions.

As described above, the handle 7 of the third embodiment ensures its vibration-proof property and improves the operability for operating the bush cutter 1.

In the third embodiment, the elastic rubbers 80 are arranged at prescribed intervals in the circumferential direction of the operation rod 2, but the arrangement is not limited to this. For example, the elastic rubbers 80 may be continuously arranged over the entire region of the operation rod 2 in the circumferential direction.

(Fourth Embodiment of the Invention)

Figure 19:
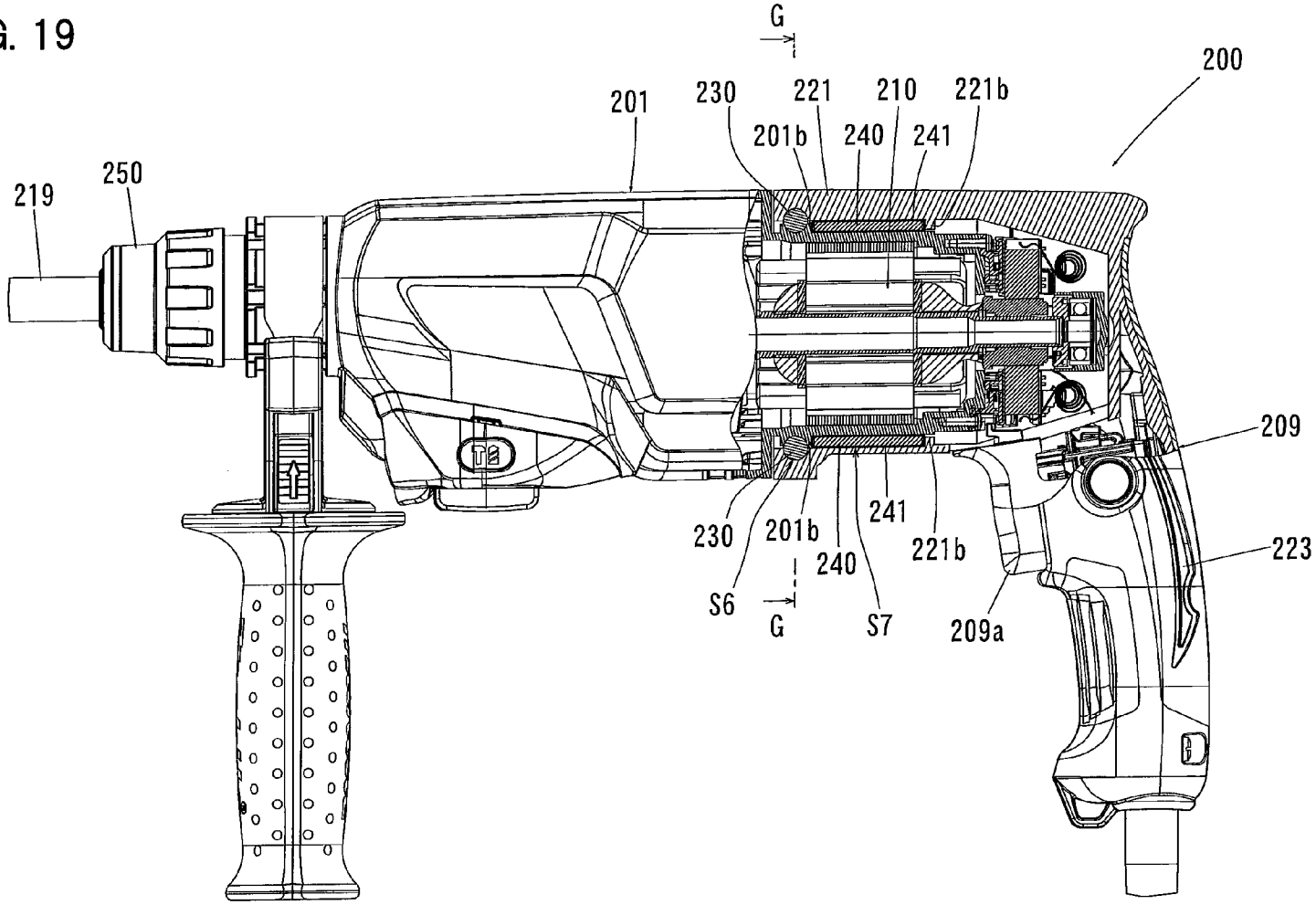
FIG. 19 is a partial sectional view showing the structure of a hammer drill having a hand grip according to a fourth embodiment of the present invention, with a section taken along line H-H in FIG. 20.
Figure 20:
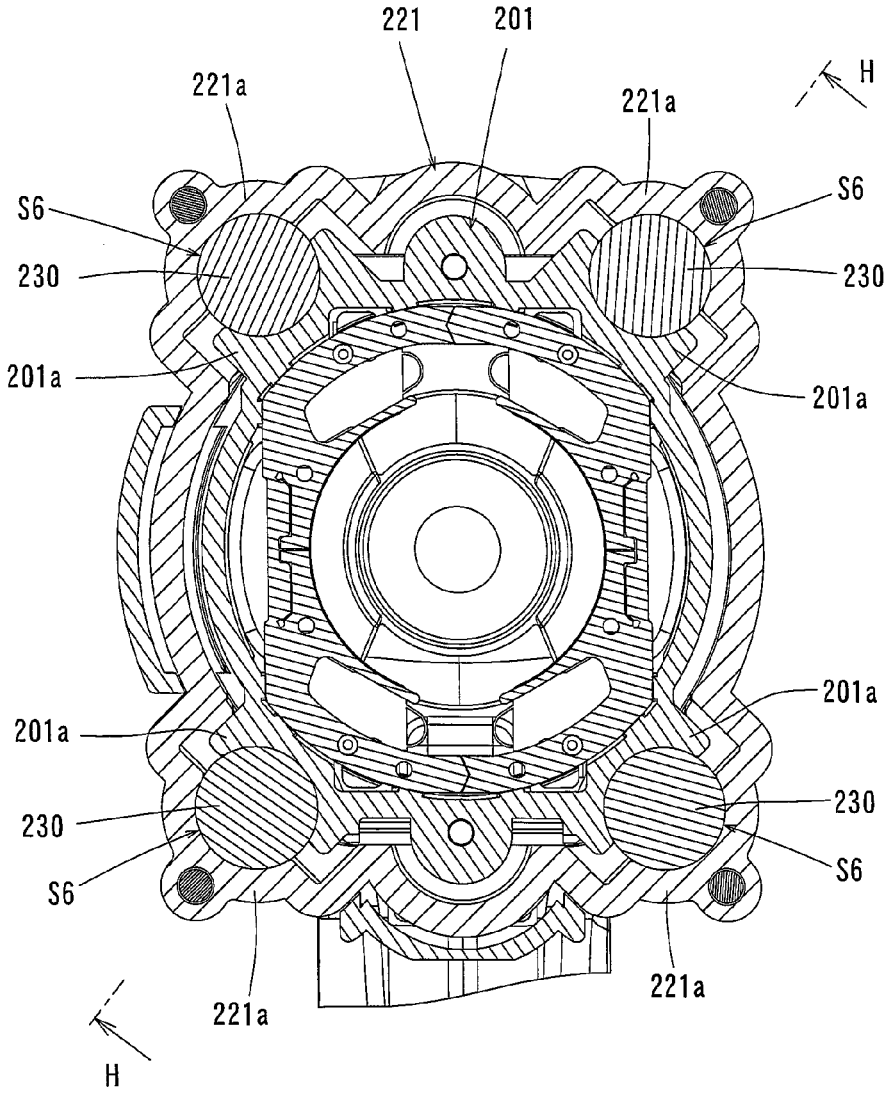
FIG. 20 is a sectional view taken along line G-G in FIG. 19.

A fourth embodiment of the present invention is now described with reference to FIGS. 19 and 20. In the fourth embodiment, the present invention is applied to a main handle of a hammer drill. As shown in FIGS. 19 and 20, a hammer drill 200 mainly includes a body housing 201 that forms an outer shell of the hammer drill 200, a handgrip 209 as a main handle to be held by a user, and a tool holder 250 for holding a hammer bit 219. The body housing 201, the handgrip 209 and the hammer bit 219 are example embodiments that correspond to the "tool body", the "handle" and the "tool bit", respectively, in the present invention.

In the fourth embodiment, for the sake of convenience, the hammer bit 219 side is defined as "the front" and the handgrip 209 side is defined as "the rear", in the axial direction of the hammer bit 219 (the longitudinal direction of the body housing 201). Further, the upper side in FIG. 19 is defined as "the upper side" and the lower side in FIG. 19 is defined as "the lower side".

The body housing 201 is formed by connecting a pair of generally symmetric housing halves together and houses an electric motor 210, a motion converting mechanism, a power transmitting mechanism and a striking mechanism (not shown). The electric motor 210 is arranged such that its rotation axis is in parallel to the axial direction of the hammer bit 219.

The handgrip 209 is connected to the body housing 201 in a rear region on the side opposite to the hammer bit 219. The handgrip 209 extends in a vertical direction crossing the axial direction of the hammer bit 219. A trigger 209*a* is provided in the handgrip 209, and when the user operates the trigger 209*a*, the electric motor 210 is driven.

When the electric motor 210 is driven, rotation of the electric motor 210 is converted into linear motion by the motion converting mechanism and then transmitted to the hammer bit 219 as linear motion in the axial direction via the striking mechanism. Thus, the hammer bit 219 is struck. Further, the hammer bit 219 is caused to rotate via the power transmitting mechanism which is driven by the electric motor 210. Therefore, the hammer bit 219 performs a hammer drill operation on a workpiece by hammering motion in the axial direction and rotating motion in the circumferential direction.

As shown in FIG. 19, the handgrip 209 mainly includes a vertically extending grip part 223 formed on the rear end of the body housing 201 to be held by a user, an elastic rubber 230 and powders 240. The grip part 223 has a generally cylindrical housing part 221 having an open front. The grip part 223 is an example embodiment that corresponds to the "grip" in the present invention. The cylindrical housing part 221 is arranged to cover a rear part (also referred to as a motor housing) of the body housing 201 which houses the electric motor 210. The motor housing is generally cylindrically shaped. The cylindrical housing part 221 is arranged to be movable with respect to the motor housing in the axial direction of the hammer bit 219.

The grip part 223 of the handgrip 209 extends downward in a prescribed length from the rear end part of the cylindrical housing part 221. The grip part 223 has an extending end formed as a free end. The handgrip 209 having the grip part 223 which is configured as described above is also referred to as a pistol type handle.

As shown in FIGS. 19 and 20, a plurality of (four in this embodiment) vibration-proofing elastic rubbers 230 are disposed between an outer surface of the body housing 201 and an inner surface of the cylindrical housing part 221 at prescribed intervals around the rotation axis of the electric motor 210 (in the circumferential direction of the cylindrical housing part 221). Thus, the cylindrical housing part 221 is connected to the body housing 201 via the four elastic rubbers 230 disposed around the rotation axis of the electric motor 210. The elastic rubbers 230 and the cylindrical housing part 221 are example embodiments that correspond to the "elastic element" and the "connecting region", respectively, in the present invention.

As shown in FIG. 20, the four elastic rubbers 230 are arranged symmetrically with respect to a vertical line crossing the rotation axis of the electric motor 210. Each of the elastic rubbers 230 is held between an outer rubber receiver 221*a* formed in the cylindrical housing part 221 and having a generally hemispherical concave surface and an inner rubber receiver 201*a* formed in the body housing 201 and having a generally hemispherical concave surface. A space S6 defined by the generally hemispherical concave surface of the outer rubber receiver 221*a* and the generally hemispherical concave surface of the inner rubber receiver 201*a* is an example embodiment that corresponds to the "elastic element interposing region" in the present invention. Further, a part of the outer surface of the elastic rubber 230 which is held in contact with the inner rubber receiver 201*a* of the body housing 201 is an example embodiment that corresponds to the "connection part" in the present invention.

In the connection part structure of connecting the cylindrical housing part 221 and the body housing 201 via the four elastic rubbers 230, as for the upper right and left connection parts with respect to the horizontal axis crossing the rotation axis of the electric motor 210, the opposed surfaces of the outer rubber receivers 221*a* and the inner rubber receivers 201*a* are formed to form a generally inverted-V shape as viewed from the handgrip 209 side (from behind). As for the lower right and left connection parts, the opposed surfaces of the outer rubber receivers 221*a* and the inner rubber receivers 201*a* are formed to form a generally V shape as viewed from the handgrip 209 side (from behind). Specifically, the opposed surfaces of the outer rubber receiver 221*a* and the inner rubber receiver 201*a* are configured to be parallel to the axial direction of the hammer bit 219 and inclined about 45 degrees in the horizontal (transverse) and vertical directions crossing the axial direction. With this structure, shearing force mainly acts upon the elastic rubbers 230 in the axial direction, and compression force mainly acts upon them in the directions crossing the axial direction.

A plurality of powder filling spaces S7 are formed between the outer circumferential surface of the body housing 201 and the inner circumferential surface of the cylindrical housing part 221 behind the connection parts formed by the elastic rubbers 230. The spaces S7 are filled with powders 240. Thus, the elastic rubbers 230 and the powders 240 are arranged side by side in a direction crossing a direction from the body housing 201 toward the cylindrical housing part 221. The space S7 and the powder 240 are example embodiments that correspond to the "powder filling region" and the "powder", respectively, in the present invention. The powder filling spaces S7 may be formed continuously over the entire region in the circumferential direction, or they may be formed at prescribed intervals in the circumferential direction. The powders 240 are filled and sealed in advance in a bag 241 formed of a flexible material such as rubber, cloth and vinyl, and the bag 241 filled with the powders 240 is disposed in each of the spaces S7.

The powders 240 disposed in the space S7 is interposed between a rib-like projection 201*b* formed on the outer circumferential surface of the body housing 201 and a rib-like projection 221*b* formed on the inner circumferential surface of the cylindrical housing part 221 in the axial direction of the hammer bit 219 and also interposed between the outer circumferential surface of the body housing 201 and the inner circumferential surface of the cylindrical housing part 221 in the radial direction crossing the axial direction.

During hammer drill operation by the hammer drill 200, vibration is caused in the body housing 201. The elastic rubbers 230 disposed between the body housing 201 and the cylindrical housing part 221 of the handgrip 209 reduce transmission of vibration to the handgrip 209 by elastically deforming in response to vibration of the body housing 201. Specifically, as for vibration in the axial direction of the hammer bit 219, transmission of vibration to the handgrip 209 is reduced by shearing deformation of the elastic rubbers 230 in the axial direction of the hammer bit 219 between the outer rubber receivers 221*a* and the inner rubber receivers 201*a*. Further, as for vibration in directions crossing the axial direction, transmission of vibration to the handgrip 209 is reduced by compressive deformation of the elastic rubbers 230 in the vertical or transverse direction crossing the axial direction of the hammer bit 219 between the outer rubber receivers 221*a* and the inner rubber receivers 201*a*. The axial direction of the hammer bit 219 and the direction crossing the axial direction are example embodiments that correspond to the "first direction" and the "second direction", respectively, in the present invention.

The powders 240 contact each other and repeat micro vibration in response to vibration of the body housing 201. At this time, kinetic energy of vibration of the body housing 201 is consumed by frictional resistance between the powders, so that vibration is reduced. As a result, transmission of vibration to the handgrip 209 is reduced. Thus, transmission of vibration from the body housing 201 to the handgrip 209 is effectively reduced.

The acceleration generated when a user holds the handgrip 209 and actuates the hammer drill 200 is smaller than the acceleration of vibration caused in the body housing 201 during hammer drill operation. Therefore, the power inputted into the handgrip 209 held by the user is received by the powders 240. Thus, the powders 240 serve to enhance the rigid feeling of the connection between the body housing 201 and the cylindrical housing part 221 and prevent wobble of the cylindrical housing part 221. As a result, operability for the user holding the handgrip 209 is improved. Thus, the handgrip 209 of the fourth embodiment ensures its vibration-proof property and improves the operability for operating the hammer drill 200.

(Fifth Embodiment of the Invention)

Figure 21:
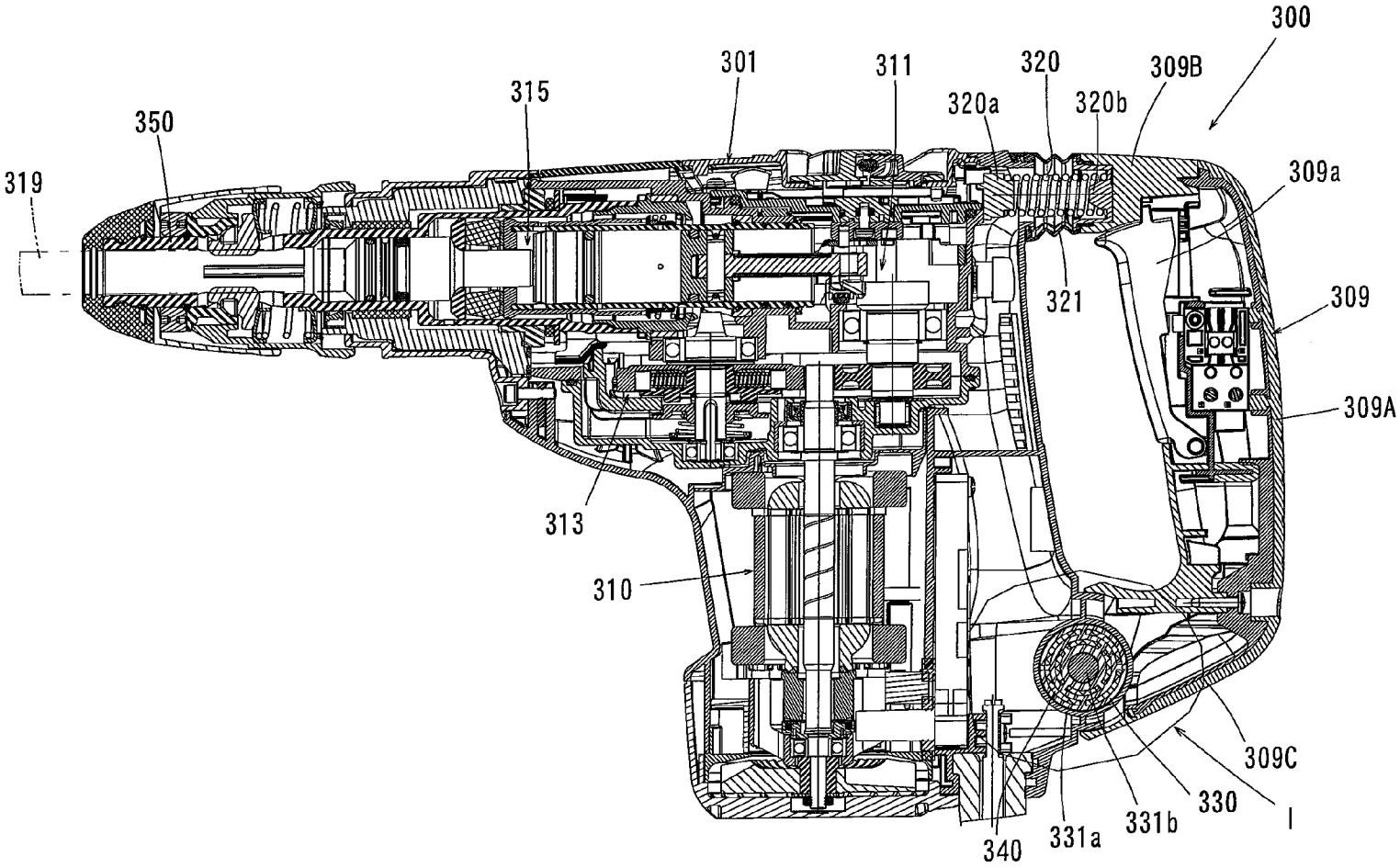
FIG. 21 is a sectional view showing the structure of a hammer drill having a hand grip of a type connected at two points according to a fifth embodiment of the present invention.

A fifth embodiment of the present invention is now described with reference to FIGS. 21 and 22. In the fifth embodiment, the present invention is applied to a main handle of a hammer drill. As shown in FIG. 21, a hammer drill 300 mainly includes a body housing 301 that forms an outer shell of the hammer drill 300, a handgrip 309 as a main handle to be held by a user, and a tool holder 350 for holding a hammer bit 319. The body housing 301, the handgrip 309 and the hammer bit 319 are example embodiments that correspond to the "tool body", the "handle" and the "tool bit", respectively, in the present invention.

In the fifth embodiment, for the sake of convenience, the hammer bit 319 side is defined as "the front" and the handgrip 309 side is defined as "the rear", in the axial direction of the hammer bit 319 (the longitudinal direction of the body housing 301). Further, the upper side in FIG. 21 is defined as "the upper side" and the lower side in FIG. 21 is defined as "the lower side".

The body housing 301 is formed by connecting a pair of generally symmetric housing halves together and houses an electric motor 310, a motion converting mechanism 311, a power transmitting mechanism 313 and a striking mechanism 315. The electric motor 310 is arranged such that its rotation axis extends in a direction crossing the axial direction of the hammer bit 319.

The handgrip 309 is disposed in a rear region of the hammer drill 300 on the side opposite to the hammer bit 319. The handgrip 309 extends in a vertical direction crossing the axial direction of the hammer bit 319. Ends of the handgrip 309 in the vertical direction are connected to the body housing 301. A trigger 309*a* is provided in the handgrip 309, and when the user operates the trigger 309*a*, the electric motor 310 is driven.

When the electric motor 310 is driven, rotation of the electric motor 310 is converted into linear motion by the motion converting mechanism 311 and then transmitted to the hammer bit 319 as linear motion in the axial direction via the striking mechanism 315. Thus, the hammer bit 319 is struck. Further, the hammer bit 319 is caused to rotate via the power transmitting mechanism 313 which is driven by the electric motor 310. Therefore, the hammer bit 319 performs a hammer drill operation on a workpiece by hammering motion in the axial direction and rotating motion in the circumferential direction.

As shown in FIG. 21, the handgrip 309 mainly includes a grip part 309A extending in the vertical direction crossing the axial direction of the hammer bit 319, an elastic rubber 330 and powders 340. The grip part 309A has an upper connecting region 309B extending forward from an upper end of the grip part 309A and connected to the body housing 301, and a lower connecting region 309C extending forward from a lower end of the grip part 309A and connected to the body housing 301. The grip part 309A is an example embodiment that corresponds to the "grip" in the present invention.

A compression coil spring 320 is disposed between a front part of the upper connecting region 309B and a rear upper part of the body housing 301. The compression coil spring 320 is arranged such that the working direction of its spring force substantially coincides with the direction of vibration which is generated in the axial direction of the hammer bit 319 during hammer drill operation. Specifically, the compression coil spring 320 is arranged to extend in the axial direction of the hammer bit 319. The compression coil spring 320 is arranged above the axis of the hammer bit 319. One end of the compression coil spring 320 in the longitudinal direction is supported by a body-side spring receiver 320*a* formed in the body housing 301, and the other end is supported by a grip-side spring receiver 320*b* formed in the upper connecting region 309B. Thus, the upper connecting region 309B of the handgrip 309 is connected to the body housing 301 via the compression coil spring 320 and can move with respect to the body housing 301 in the axial direction of the hammer bit 319. The compression coil spring 320 is covered by an extensible rubber dustproof cover 321 disposed between the body housing 301 and the upper connecting region 309B. The upper connecting region 309B is an example embodiment that corresponds to the "connecting region" in the present invention.

Figure 22:
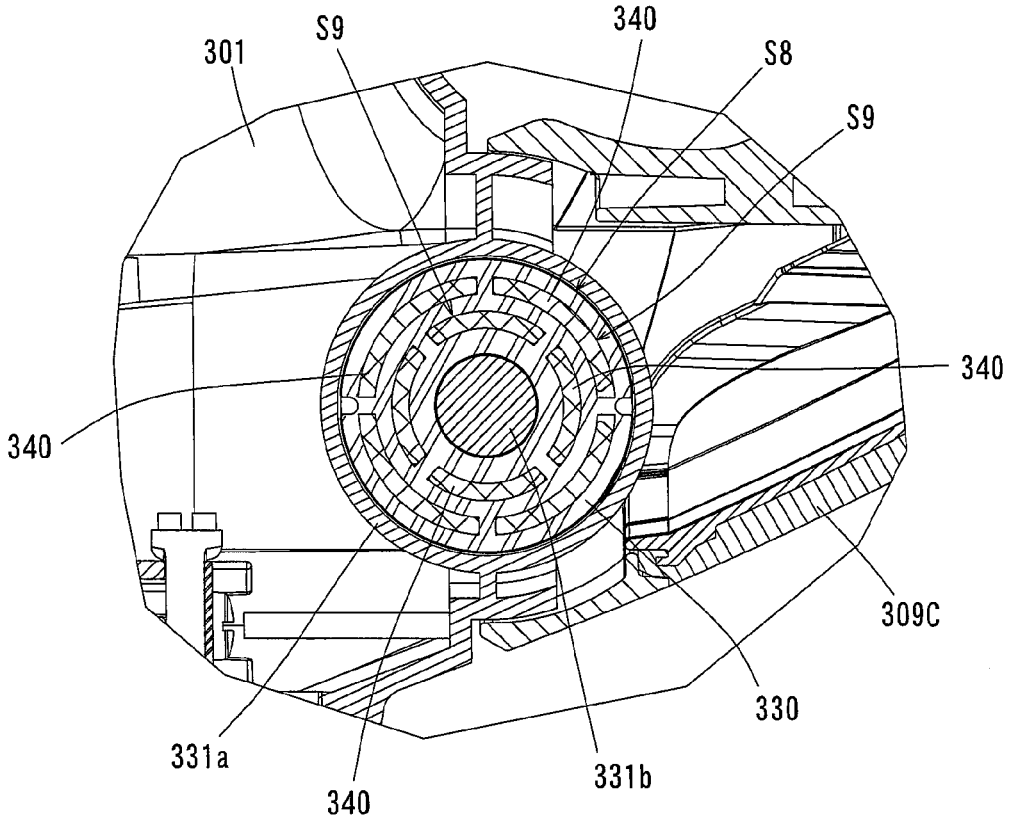
FIG. 22 is an enlarged view of part I of FIG. 21.

As shown in FIGS. 21 and 22, the lower connecting region 309C is connected to a rear lower part of the body housing 301 via the elastic rubber 330. The elastic rubber 330 and the lower connecting region 309C are example embodiments that correspond to the "elastic element" and the "connecting region", respectively, in the present invention. The elastic rubber 330 has a cylindrical shape having a circular hole 330*a* in the center. The inside of the elastic rubber 330 is filled with the powders 340. Specifically, as shown in FIG. 22, a plurality of arcuate spaces S9 are formed in the elastic rubber 330 in two rows in the radial direction and at prescribed intervals in the circumferential direction of the elastic rubber 330. At least one end of the space S9 in the longitudinal direction of the elastic rubber 330 is open as a filling port for the powders 340 and closed after the powders 340 are filled in. The arcuate space S9 and the powder 340 are example embodiments that correspond to the "powder filling region" and the "powder", respectively, in the present invention.

The elastic rubber 330 filled with the powders 340 is disposed between a cylindrical outer rubber receiver 331*a* formed in the rear lower part of the body housing 301 and a columnar inner rubber receiver 331*b* coaxially arranged within the outer rubber receiver 331*a*. Thus, the elastic rubber 330 and the powders 340 are arranged side by side in a direction from the outer rubber receiver 331*a* toward the columnar inner rubber receiver 331*b* (the center). The outer rubber receiver 331*a* and the inner rubber receiver 331*b* are configured such that their longitudinal direction coincides with the transverse direction crossing the axial direction of the hammer bit 319. Ends of the columnar inner rubber receiver 331*b* in the longitudinal direction are fixedly supported by a front end part of the lower connecting region 309C. A space S8 defined between the outer rubber receiver 331*a* and the inner rubber receiver 331*b* is an example embodiment that corresponds to the "elastic element interposing region" in the present invention. Further, a part of the outer circumferential surface of the elastic rubber 330 which is held in contact with the cylindrical outer rubber receiver 331*a* is an example embodiment that corresponds to the "connection part" in the present invention.

The elastic rubber 330 is fitted in the outer rubber receiver 331*a*, and the outer circumferential surface of the elastic rubber 330 is received by the inner circumferential surface of the outer rubber receiver 331*a*. The inner rubber receiver 331*b* is fitted in the circular hole 330*a* of the elastic rubber 330, and the inner circumferential surface of the elastic rubber 330 is received by the outer circumferential surface of the inner rubber receiver 331*b*. Thus, the lower connecting region 309C of the handgrip 309 is connected to the body housing 301 via the elastic rubber 330 filled with the powders 340 and can move with respect to the body housing 301 in the axial direction of the hammer bit 319.

During hammer drill operation by the hammer drill 300, vibration is caused in the body housing 301. The compression coil spring 320 disposed between the body housing 301 and the upper connecting region 309B and the elastic rubber 330 disposed between the body housing 301 and the lower connecting region 309C reduce transmission of vibration to the handgrip 309 by elastically deforming in response to vibration of the body housing 301. Specifically, as for vibration in the axial direction of the hammer bit 319, transmission of vibration to the handgrip 309 is reduced by compressive deformation of the elastic rubber 330 in the axial direction of the hammer bit 319 between the outer rubber receiver 331*a* and the inner rubber receiver 331*b*. Further, as for vibration in directions crossing the axial direction, transmission of vibration to the handgrip 309 is reduced by compressive deformation of the elastic rubber 330 in the vertical or transverse direction crossing the axial direction of the hammer bit 319 between the outer rubber receiver 331*a* and the inner rubber receiver 331*b*. The axial direction of the hammer bit 319 and the direction crossing the axial direction are example embodiments that correspond to the "first direction" and the "second direction", respectively, in the present invention.

The powders 340 filled in the inside of the elastic rubber 330 contact each other and repeat micro vibration in response to vibration of the body housing 301. At this time, kinetic energy of vibration of the body housing 301 is consumed by frictional resistance between the powders, so that vibration is reduced. As a result, transmission of vibration to the handgrip 309 is reduced. Thus, transmission of vibration from the body housing 301 to the handgrip 309 is effectively reduced.

The acceleration generated when a user holds the handgrip 309 and actuates the hammer drill 300 is smaller than the acceleration of vibration caused in the body housing 301 during hammer drill operation. Therefore, the power inputted into the handgrip 309 held by the user is received by the powders 340. Thus, the powders 340 serve to enhance the rigid feeling of the connection between the body housing 301 and the lower connecting region 309C and prevent wobble of the lower connecting region 309C. As a result, operability for the user holding the handgrip 309 is improved. Thus, the handgrip 309 of the fifth embodiment ensures its vibration-proof property and improves the operability for operating the hammer drill 300.

In the fifth embodiment, the powders 340 are arranged at a plurality of positions in the inside of the elastic rubber 330, but the arrangement is not limited to this. For example, the powders 340 may be arranged continuously over the entire region of the elastic rubber 330 in the circumferential direction. Further, the elastic rubber 330 has a cylindrical shape, but it may have a quadrangular prism shape. In this case, a front half of the quadrangular prism is supported by the body housing 301, and a rear half of the quadrangular prism is supported by the lower connecting region 309C. Further, the elastic rubber 330 filled with the powders 340 may be disposed in the upper connecting region 309B.

In the above-described embodiments, the powders are described as being directly disposed between the "connection part" and the "grip" in this invention, or disposed between the elastic rubbers, but may be disposed otherwise. For example, the present invention also suitably includes the manner in which the powders are disposed between the elastic rubber and the "connection part", and the manner in which the powders are disposed between the elastic rubber and the "grip".

In the above-described embodiments, the electric grinder 150, the bush cutter 1 and the hammer drills 160, 200, 300 are explained as representative examples of the power tool, but the present invention is not limited to them. For example, the present invention may also be applied to an auxiliary handle or a main handle of a reciprocating saw or a hammer.

In view of the nature of the present invention, the following features can be provided.

(Aspect 1)

The power tool as defined in claim 8, wherein the powder filling region is arranged between the elastic element and the connection part, between the elastic element and the grip, between the connection part and the grip, or between the elastic elements.

According to aspect 1, the powders are rationally arranged to cope with vibrations in a plurality of directions.

(Aspect 2)

The power tool as defined in claim 10, wherein the elastic element is directly connected to the tool body.

According to aspect 2, the elastic element is rationally connected to the tool body by direct connection.

(Correspondences Between the Features of the Embodiments and the Features of the Invention)

Correspondences between the features of the embodiments and the features of the invention are as follows. The above-described embodiments are representative examples for embodying the present invention, and the present invention is not limited to the structures that have been described as the representative embodiments.

The grip body 110, a contact part of the elastic rubber 80 with the projection 21*a*, a contact part of the elastic rubber 230 with the inner rubber receiver 201*a*, a contact part of the elastic rubber 330 with the outer rubber receiver 331*a* are example embodiments that correspond to the "connection part" according to the present invention.

The grip parts 120, 71, 223, 309A are example embodiments that correspond to the "grip" in the present invention.

The elastic rubbers 130, 80, 230, 330 are example embodiments that correspond to the "elastic element" in the present invention.

The powders 140, 90, 240, 340 are example embodiments that correspond to the "powder" according to the present invention.

The first space S1, the second space S2, the cylindrical space S4 and the space S6 and the space S8 are example embodiments that correspond to the "elastic element interposing region" in the present invention.

The third space S3, the housing groove 115*b*, the cylindrical space S5, the space S7 and the space S9 are example embodiments that correspond to the "powder filling region" in the present invention.

The projections 114*c*, 117*c*, the recesses 122*b* and the protruding parts 130*c* of the elastic rubber 130 which are disposed between the projections 114*c*, 117*c* and the recesses 122*b* are example embodiments that correspond to the "rotation stopper" in the present invention.

The powder 140 between the projections 121*a* and the plate-like member 115*a* is an example embodiment that corresponds to the "rotation stopper" in the present invention.

The tube-like bag 141 is an example embodiment that corresponds to the "bag" in the present invention.

The body housings 151, 161, the operation rod 2, the body housings 201, 301 are example embodiments that correspond to the "tool body" in the present invention.

The operation rod 2 is an example embodiment that corresponds to the "operation rod" in the present invention.

The power unit 3 is an example embodiment that corresponds to the "driving unit" in the present invention.

The cutting unit 4 is an example embodiment that corresponds to the "cutting unit" in the present invention.

The handgrips 209, 309 are example embodiments that correspond to the "handle" in the present invention.

The hammer bits 219, 319 are example embodiments that correspond to the "tool bit" in the present invention.

DESCRIPTION OF NUMERALS

1 bush cutter
2 operation rod
3 power unit
4 cutting unit
5 cutting blade
7 handle
9 rotary shaft
21, 23 support part
21*a*, 23*a* projection
71 grip part
73 cylindrical member
75, 77 connecting part
75*a*, 77*a* recess
100 side grip
110 grip body
111 mounting bolt
111*a* width across flat shank
111*b* threaded part
112 insert bolt
113 bolt holder
114 large-diameter shank
114*a* flange
114*b* engagement groove
114*c* projection
115 rod-like part
115*a* plate-like member
115*b* housing groove
116 small-diameter shank
116*a* threaded hole
117 end cap
117*a* flange
117*b* engagement groove
117*c* projection
117*d* through hole
120 grip part
121 cylindrical part
121*a* projection
122 large-diameter cylindrical part
122*a* stepped part
122*b* recess
130 elastic rubber
130*a* cylindrical part

130*b* stepped part
130*c* protruding part
130*d* engagement part
140 powder
141 bag
150 electric grinder
151 body housing
153 main grip part
160 hammer drill
161 body housing
163 handgrip
165 ring-like mounting member
200 hammer drill
201 body housing
201*a* inner rubber receiver
201*b* projection
209 handgrip
209*a* trigger
210 electric motor
219 hammer bit
221 cylindrical housing part
221*a* outer rubber receiver
223 grip part
230 elastic rubber
240 powder
241 bag
250 tool holder
300 hammer drill
301 body housing
309 handgrip
309*a* trigger
309A grip part
309B upper connecting region
309C lower connecting region
310 electric motor
311 motion converting mechanism
313 power transmitting mechanism
315 striking mechanism
319 hammer bit
320 compression coil spring
320*a*, 320*b* spring receiver
321 dustproof cover
330 elastic rubber
330*a* circular hole
331*a* outer rubber receiver
331*b* inner rubber receiver
340 powder
350 tool holder
S1 first space
S2 second space
S3 third space
S4 cylindrical space
S5 cylindrical space
S6 space
S7 space
S8 space
S9 space

The invention claimed is:

1. A power tool comprising:
an operation rod as a tool body;
a handle that is connected to an operation rod;
a cutting unit that is disposed on one end of the operation rod and rotatably supports a cutting blade; and
a driving unit that is disposed on the other end of the operation rod and drives the cutting blade;
wherein the handle includes:
a grip,
a cylindrical member integrally connected to the grip and coaxially disposed on the outside of the operation rod,
a support part provided on the operation rod,
an elastic element interposing region,
an elastic element disposed in the elastic element interposing region,
a powder filling region, and
powders filled in the powder filling region,
wherein the handle, the elastic element and the powder filling region are formed in a plane orthogonal to a longitudinal direction of the operation rod, and
wherein the elastic element interposing region is formed between the cylindrical member and the support part, and the powder filling region is formed in the elastic element.

2. The power tool as defined in claim 1, wherein the elastic element interposing region and the powder filling region are formed side by side in a direction from a region of a connection part which is connected to the tool body toward the grip.

3. The power tool as defined in claim 1, wherein the elastic element and the powders are arranged to reduce vibration which is caused in the tool body in a first direction and a second direction different from the first direction and transmitted from a connection part to the grip.

4. The power tool as defined in claim 3, wherein the first direction corresponds to a direction in which the operation rod extends, and the elastic element is arranged to compressively deform in the first direction.

5. The power tool as defined in claim 3, wherein:
the elastic element interposing region is formed between the operation rod and the connection part.

6. The power tool as defined in claim 5, wherein:
a plurality of such elastic elements are arranged in a circumferential direction around a center line of the operation rod, and
the powders are filled inside the elastic elements.

* * * * *